US011545023B1

(12) United States Patent
Kalyanasundaram et al.

(10) Patent No.: US 11,545,023 B1
(45) Date of Patent: Jan. 3, 2023

(54) SYSTEMS AND METHODS FOR MONITORING A PHYSICAL ENVIRONMENT USING VIRTUAL SENSORS

(71) Applicants: Verizon Patent and Licensing Inc., Basking Ridge, NJ (US); Verizon Deutschland GmbH, Frankfurt am Main (DE)

(72) Inventors: Vaidyanathan Kalyanasundaram, Chennai (IN); Cesar Jeri, London (GB); Marek Mycawka, Northamptonshire (GB); Dirk Schlotter, Eltville (DE); Muthu Chandrasekaran, Tamil Nadu (IN); Richard Joel, Tamil Nadu (IN); Sri Vinayak Katta Chanukya, Telangana (IN); Michael Bonomo, Clinton, NJ (US); Venkat Swaminathan, Edison, NJ (US)

(73) Assignees: Verizon Patent and Licensing Inc., Basking Ridge, NJ (US); Verizon Deutschland GmbH, Frankfurt am Main (DE)

( * ) Notice: Subject to any disclaimer, the term of this patent is extended or adjusted under 35 U.S.C. 154(b) by 0 days.

(21) Appl. No.: 17/368,481

(22) Filed: Jul. 6, 2021

(51) Int. Cl.
*G08B 21/18* (2006.01)
*G08B 5/22* (2006.01)

(52) U.S. Cl.
CPC ..... *G08B 21/182* (2013.01); *G08B 5/22* (2013.01)

(58) Field of Classification Search
CPC ..... G08B 21/182; G08B 5/22
See application file for complete search history.

(56) References Cited

U.S. PATENT DOCUMENTS

| | | | | |
|---|---|---|---|---|
| 10,890,121 | B1 * | 1/2021 | Logendran | F02D 28/00 |
| 2001/0045892 | A1 * | 11/2001 | Thomas | G08B 21/182 379/38 |
| 2014/0222813 | A1 * | 8/2014 | Yang | G06F 16/95 707/736 |
| 2015/0071450 | A1 * | 3/2015 | Boyden | G08B 21/182 381/58 |
| 2015/0194039 | A1 * | 7/2015 | Martin | G08B 21/182 340/632 |
| 2017/0235692 | A1 * | 8/2017 | Ahamed | G06F 1/3215 710/308 |
| 2018/0197393 | A1 * | 7/2018 | Gallo | G08B 25/10 |
| 2018/0293864 | A1 * | 10/2018 | Wedig | G08B 13/22 |

(Continued)

*Primary Examiner* — Ojiako K Nwugo

(57) ABSTRACT

In some implementations, a system may identify a plurality of sensor devices that are associated with a physical environment. The system may receive an indication that a set of sensor devices (e.g., that includes two or more sensor devices) are to be associated with a virtual sensor that is associated with the physical environment. The system may generate, based on receiving the indication, the virtual sensor. The system may obtain sensor data that was captured by the set of sensor devices. The system may process the sensor data to determine a set of parameters associated the virtual sensor. The system may determine, based on the set of parameters associated with the virtual sensor, that a physical environment condition is satisfied. The system may cause, based on determining that the physical environment condition is satisfied, one or more actions to be performed.

20 Claims, 15 Drawing Sheets

(56) References Cited

U.S. PATENT DOCUMENTS

| | | | | |
|---|---|---|---|---|
| 2018/0306609 | A1* | 10/2018 | Agarwal | H04L 67/12 |
| 2019/0109818 | A1* | 4/2019 | Baum | G08B 21/182 |
| 2019/0130733 | A1* | 5/2019 | Hodge | G06V 20/52 |
| 2019/0332901 | A1* | 10/2019 | Doumbouya | G01S 13/886 |
| 2020/0314606 | A1* | 10/2020 | Stevens | A41D 1/002 |
| 2021/0201391 | A1* | 7/2021 | Metev | G06Q 30/0645 |
| 2021/0319686 | A1* | 10/2021 | Bayless | G01M 5/0041 |
| 2021/0383611 | A1* | 12/2021 | Kanski | G06T 19/006 |

* cited by examiner

SYSTEMS AND METHODS FOR MONITORING A PHYSICAL ENVIRONMENT USING VIRTUAL SENSORS

BACKGROUND

A sensor device is an electronic device that takes input from a physical environment and produces a signal that represents information about the physical environment. Sensor devices can be used as monitoring and control mechanisms in various physical environments.

DETAILED DESCRIPTION OF PREFERRED EMBODIMENTS

Figure 1A:
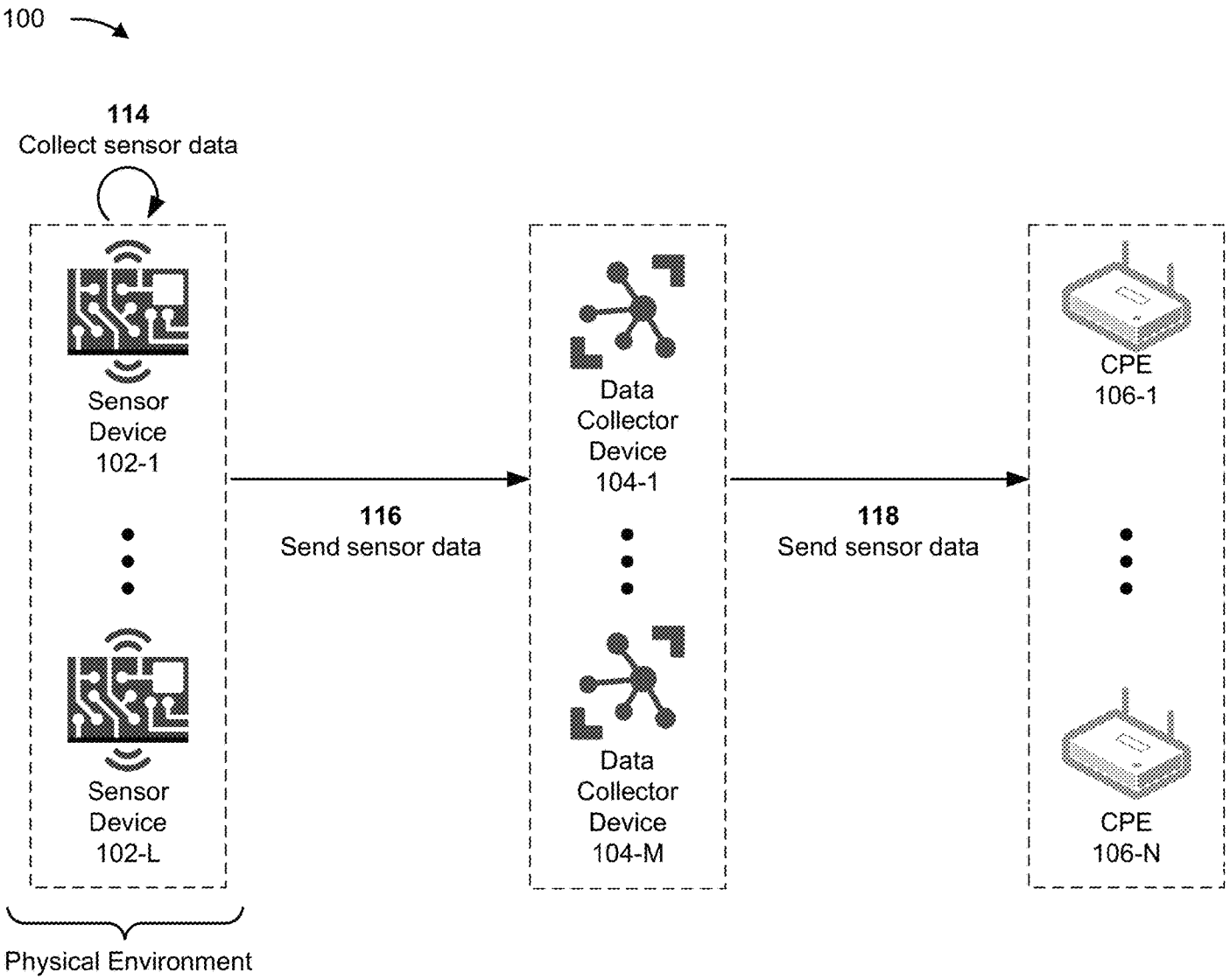
FIGS. 1A-1G are diagrams of one or more examples associated with monitoring a physical environment using virtual sensors.

The following detailed description of example implementations refers to the accompanying drawings. The same reference numbers in different drawings may identify the same or similar elements.

Multiple sensor devices may be deployed in a physical environment (e.g., an office building, an apartment building, a house, a hotel, a stadium, an arena, or a theater, among other examples) to measure attributes of the physical environment. For example, the sensor devices may capture measurements related to temperature, humidity, presence of water (e.g., pipe leaks), ambient light levels, device usage, and/or door usage, among other examples, within the physical environment. However, in many cases, individual sensor devices are configured to measure a single attribute of the physical environment and/or are not configured to communicate with other sensor devices. Accordingly, even when a collection hub device obtains sensor data from an array of sensor devices distributed throughout the physical environment, the collection hub device can only determine individual measurement values associated with attributes of the physical environment and is not able to make higher level status determinations regarding the physical environment. Further, when the number of deployed sensor devices is large (e.g., in the hundreds, thousands, or more of sensor devices) and/or the types of deployed sensor devices is large (e.g. in the tens, hundreds, or more types of sensor devices) the collection hub can collect large amounts of the sensor data, but is not able to analyze the sensor data to provide actionable intelligence or automated actions to cause devices and/or systems that are configured to service the physical environment to be maintained and/or operated in an efficient and/or effective manner. This causes the devices and/or systems to inefficiently consume computing resources (e.g., processing resources, memory resources, communication resources, among other examples), power resources, fuel resources, and/or other resources.

Some implementations described herein provide a monitoring system that monitors a physical environment based on sensor data provided by a plurality of sensor devices. The plurality of sensor devices may be configured to measure different attributes of the physical environment and may send sensor data associated with these measurements to one or more data collector devices (e.g., that are configured to collect the sensor data from the plurality of sensor devices). The one or more data collector devices may provide the sensor data to one or more customer premises equipment (e.g., that are configured to communicate with other devices over a network, such as the Internet), which may provide the sensor data to a gateway device. The gateway device may preprocess the sensor data (e.g., authenticate and validate the sensor data) and provide the sensor data to the monitoring system. In this way, the gateway device ensures that erroneous and/or potentially malicious sensor data is removed before the sensor data is sent to the monitoring system.

The monitoring system may identify a set of sensor data, of the sensor data, that was captured by a set of sensor devices (e.g., two or more sensor devices) that are associated with a virtual sensor. The virtual sensor may be configured to measure one or more attributes of the physical environment based on measurements captured by the set of sensor devices. In some implementations, the virtual sensor may measure an attribute of the physical environment that is not measured by the set of sensor devices, but that can be determined by processing the set of sensor data captured by the set of sensor devices. Accordingly, the monitoring system may process the set of sensor data to determine a set of parameters associated with the virtual sensor (e.g., that indicate a set of measurements associated with one or more attributes of the physical environment that the virtual sensor is configured to measure). In some implementations, the monitoring system may determine, based on the set of parameters, that a physical condition is satisfied and thereby may cause one or more actions to be performed, such as sending an alert or notification to a client device, dispatching a service operator to service a device of the physical environment, adjusting a setting of the device associated with the physical environment, and/or generating a work order to service the device.

In this way, the monitoring system may monitor the physical environment using virtual sensors. Further, the monitoring system may be able to make status determinations regarding the physical environment that would not be possible based on just reading the sensor data obtained from the plurality of sensor devices. For example, when a set of sensor data includes temperature measurements and humidity measurements associated with a location of the physical environment, the monitoring system may process the set of sensor data to determine, for a virtual sensor that is associated with a temperature sensor device and a humidity sensor device that captured the set of sensor data, a heat index measurement (e.g., an indication of how ambient air feels to an occupant of the physical environment) associated with the location. As another example, when a set of sensor data includes temperature measurements and door usage measurements associated with a location of the physical environment, the monitoring system may process the set of sensor data to determine, for a virtual sensor that is associated with a temperature sensor device and a door usage sensor device that captured the set of sensor data, an occupancy measurement associated with the location (e.g., an indication of a number of people within the location). Accordingly, for these examples, the monitoring system may cause an air conditioner device to be serviced, or a setting of the air conditioner device to be changed, to ensure a comfortable heat index is maintained for the location and/or to ensure a particular amount of ventilation for the occupants of the location.

In this way, the monitoring system may proactively control devices and/or systems associated with the physical environment and thereby reduce an overall usage of computing resources (e.g., processing resources, memory resources, communication resources, among other examples), power resources, fuel resources, and/or other resources that would be needed when just reactively controlling the devices and/or systems (e.g., when not using virtual sensors to monitor the physical environment).

Moreover, the monitoring system may provide an interactive user interface for display (e.g., on a client device). The interactive user interface may include a dashboard that indicates status information related to the plurality of sensor devices and/or one or more virtual sensors that are associated with the physical environment. In some implementations, the interactive user interface may include an interactive map that indicates a physical location of at least one sensor device within the physical environment and/or a physical location within the physical environment that is associated with at least one virtual sensor.

In this way, the monitoring system may present, via the interactive user interface, information related to a large number of sensor devices and virtual sensors (e.g., in the hundreds, thousands, or more of sensor devices and virtual sensors) and/or a large number of types of sensor devices and/or virtual sensors (e.g. in the tens, hundreds, or more types of sensor devices) in an organized and/or comprehensive manner. This may allow a user of the client device that is interacting the interactive user interface to quickly and/or efficiently identify and address issues to improve a performance of devices and/or systems of the physical environment that service the physical environment.

FIGS. 1A-1G are diagrams of one or more examples 100 associated with monitoring a physical environment using virtual sensors. As shown in FIGS. 1A-1G, example(s) 100 may include a plurality of sensor devices 102 (shown as sensor devices 102-1 through 102-L, where L≥2), one or more data collector devices 104 (shown as data collector devices 104-1 through 104-M, where M≥1), one or more customer premises equipment (CPE) (shown as CPE 106-1 through 106-N, where N≥1), a gateway device 108, a client device 110, and/or a monitoring system 112. The gateway device 108, the client device 110, and/or the monitoring system 112 may be connected to each other via a network (e.g., the network 320 described herein in relation to FIG. 3). Further details of the plurality of sensor devices 102, the data collector devices 104, the CPEs 106, the gateway device 108, the client device 110, and the monitoring system 112 are provided below.

The plurality of sensor devices 102 may be positioned within a physical environment (e.g., an office building, an apartment building, a house, a hotel, a stadium, an arena, or a theater, among other examples). For example, each sensor device 102, of the plurality of sensor devices 102, may be positioned at a particular physical location (e.g., a particular longitude, a particular latitude, a particular floor, and/or a particular elevation) within the physical environment. Further, each sensor device 102, of the plurality of sensor devices 102, may be configured to measure one or more attributes of the physical environment. For example, the plurality of sensor devices 102 may include a thermometer that measures a temperature of the physical environment (e.g., a temperature associated with a physical location of the thermometer), a humidistat that measures a humidity of the physical environment (e.g., a humidity associated with a physical location of the humidistat), a water detector that measures a presence of water within the physical environment (e.g., a presence of water at a physical location of the water detector), a device usage detector that detects usage of a device (e.g., a coffee machine, a microwave, a refrigerator, or a copier machine, among other examples) within the physical environment (e.g., usage of a device at a physical location of the device usage detector), a door usage detector that detects usage of a door within the physical environment (e.g., usage of a door at a physical location of the door usage detector), and/or another sensor device. The plurality of sensor devices 102 may be associated with one or more sensor groups. In some implementations, a sensor group may include a set of sensor devices 102, of the plurality of sensor devices 102, that are of the same type (e.g., a sensor group of thermometers, a sensor group of humidistats, or a sensor group of water detectors, among other examples), that are provided by the same vendor (e.g., a sensor group of sensor devices 102 that are associated with a same company or brand), and/or that are within a particular region of the physical environment (e.g., a sensor group of sensor devices 102 that are on a same floor or in a same room), among other examples.

As shown in FIG. 1A, and by reference number 114, the plurality of sensor devices 102 may collect sensor data associated with the physical environment. For example, a first sensor device 102 may collect sensor data associated with a temperature of the physical environment (e.g., a temperature associated with a physical location of the first sensor device 102), a second sensor device 102 may collect sensor data associated with a humidity of the physical environment (e.g., a humidity associated with a physical location of the second sensor device 102), a sensor device 102 may collect sensor data associated with a presence of water within the physical environment (e.g., a presence of water at a physical location of the third sensor device 102), and so on.

As further shown in FIG. 1A, and by reference number 116, the plurality of sensor devices 102 may send the sensor data to the one or more data collector devices 104. For example, a first set of sensor devices 102, of the plurality of sensor devices 102, may send sensor data captured by the first set of sensor devices 102 to a first data collector device 104, of the one or more data collector devices 104, a second set of sensor devices 102, of the plurality of sensor devices 102, may send sensor data captured by the second set of sensor devices 102 to a second data collector device 104, of the one or more data collector devices 104, and so on. In some implementations, a data collector device 104, of the one or more data collector devices 104, may comprise a hub, a bridge, or other collector device for obtaining sensor data from a set of sensor devices 102 of the plurality of sensor devices 102. In some implementations, the plurality of sensor devices 102 may send the sensor data to the one or more data collector devices 104 via a wired connection, a wireless connection, and/or a combination of a wired and a wireless connection. The plurality of sensor devices 102 may send the sensor data to the one or more data collector devices 104 as part of a "push" operation. For example, the plurality of sensor devices 102 may send the sensor data to the one or more data collector devices 104 on a scheduled basis, on an on-demand basis, on a triggered basis, or on an ad-hoc basis.

As further shown in FIG. 1A, and by reference number 118, the plurality of data collector devices 104 may send the sensor data to the one or more CPEs 106. For example, a first set of data collector devices 104, of the one or more data collector devices 104, may send sensor data obtained by the first set of data collector devices 104 to a first CPE 106, of the one or more CPEs 106, a second set of data collector devices 104, of the one or more data collector devices 104, may send sensor data obtained by the second set of data collector devices 104 to a second CPE 106, of the one or more CPEs 106, and so on. In some implementations, a CPE 106, of the one or more CPEs 106, may comprise a modem, a router, a network switch, and/or a wireless access point (e.g., for communicating with the network described herein). In some implementations, the one or more data collector devices 104 may send the sensor data to the one or more CPEs 106 via a wired connection, a wireless connection, and/or a combination of a wired and a wireless connection. In some implementations, the one or more data collector devices 104 may send the sensor data to the one or more CPEs 106 as part of a "pull" operation. For example, the one or more CPEs 106 may send (e.g., on a scheduled basis, on an on-demand basis, on a triggered basis, or on an ad-hoc basis) a request to the one or more data collector devices 104 for the sensor data, and the one or more data collector devices 104, in response to the request, may send the sensor data to the one or more CPEs 106. Alternatively, the one or more data collector devices 104 may send the sensor data to the one or more CPEs 106 as part of a "push" operation. For example, the one or more data collector devices 104 may send the sensor data to the one or more CPEs 106 on a scheduled basis, on an on-demand basis, on a triggered basis, or on an ad-hoc basis.

As further shown in FIG. 1A, and as described above, the plurality of sensor devices 102 may be physically located within the physical environment. In some implementations, the one or more data collector devices 104 and/or the one or more CPEs 106 also may be physically located within the physical environment.

Figure 1B:
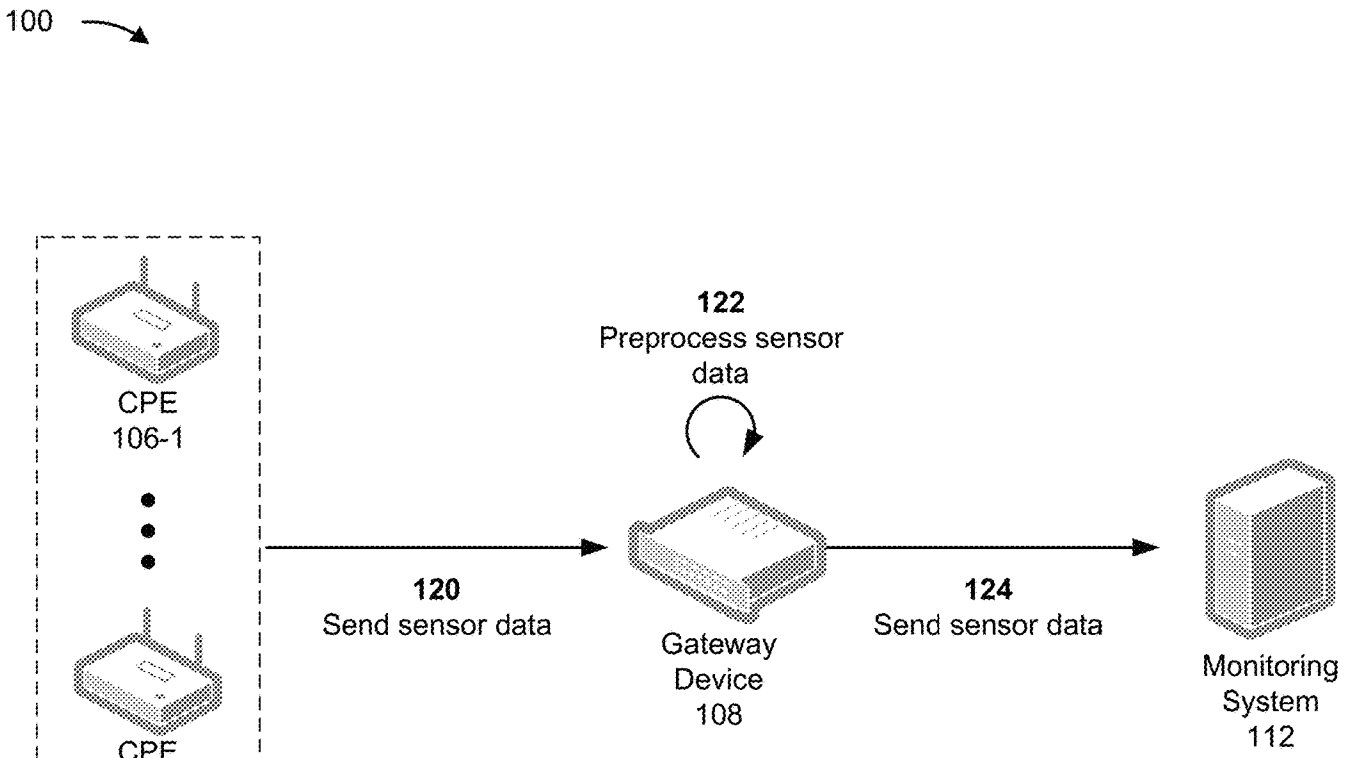

As shown in FIG. 1B, and by reference number 120, the one or more CPEs 106 may send the sensor data to the gateway device 108. For example, a first set of CPEs 106, of the one or more CPEs 106, may send sensor data obtained by the first set of CPEs 106 to the gateway device 108, a second set of CPEs 106, of the one or more CPEs 106, may send sensor data obtained by the second set of CPEs 106 to the gateway device 108, and so on. In some implementations, the gateway device 108 may comprise a computing device and/or routing device for providing sensor data to the monitoring system 112 (and/or a cloud computing system 302 associated with the monitoring system 112, described herein). In some implementations, the one or more CPEs 106 may send the sensor data to the gateway device 108 via the network described herein. In some implementations, the one or more CPEs 106 may send the sensor data to the gateway device 108 as part of a "pull" operation. For example, the gateway device 108 may send (e.g., on a scheduled basis, on an on-demand basis, on a triggered basis, or on an ad-hoc basis) a request to the one or more CPEs 106 for the sensor data, and the one or more CPEs 106, in response to the request, may send the sensor data to the gateway device 108. Alternatively, the one or more CPEs 106 may send the sensor data to the gateway device 108 as part of a "push" operation. For example, the plurality of CPEs 106 may send the sensor data to the gateway device 108 on a scheduled basis, on an on-demand basis, on a triggered basis, or on an ad-hoc basis.

As further shown in FIG. 1B, and by reference number 122, the gateway device 108 may preprocess the sensor data. In some implementations, preprocessing the sensor data may include authenticating the sensor data and/or validating the sensor data. For example, to authenticate the sensor data, the gateway device 108 may process the sensor data to determine respective network locations of the plurality of sensor devices 102 (e.g., process header information included in headers of packets of the sensor data, process token information included in tokens included in the sensor data, or process other information included in the sensor data to determine originating network address information, such as Internet protocol (IP) address information, associated with the sensor data). The gateway device 108 may search a list of network locations (e.g., a list of "allowed" network locations) and may determine that the respective network locations of a first set of sensor devices 102, of the plurality of sensor devices 102, are included in the list and/or may determine that the respective network locations of a second set of sensor devices 102, of the plurality of sensor devices 102, are not included in the list. Accordingly, the gateway device 108 may process the sensor data to cause the first set of data that is associated with the first set of sensor devices to remain in the sensor data and/or may process the sensor data to cause a second set of data that is associated with the second set of sensor devices to be removed from the sensor data. In this way, the gateway device 108 may remove irrelevant data or potentially malicious data from the sensor data.

As another example, to validate the sensor data, the gateway device 108 may identify a particular set of sensor data, of the sensor data, that is associated with a particular sensor device 102 of the plurality of sensor devices 102. The gateway device 108 may determine that a value associated with the particular set of sensor data (e.g., a temperature value, a humidity value, and/or water presence value, among other examples) is not within an expected value range associated with the particular sensor device (e.g., the value indicates that the particular sensor device is not configured properly, is malfunctioning, or is not otherwise operating correctly). Accordingly, the gateway device 108 may process the sensor data to remove the particular sensor data from the sensor data. In this way, the gateway device 108 may remove erroneous data from the sensor data.

As further shown in FIG. 1B, and by reference number 124, the gateway device 108 may send the sensor data to the monitoring system 112. For example, the gateway device 108 may send the sensor data to the monitoring system 112 via the network described herein. In some implementations, the monitoring system 112 may comprise a computing device and may be configured to process the sensor data, as described herein, to monitor the physical environment. In some implementations, the gateway device 108 may send the sensor data to the monitoring system 112 as part of a "pull" operation. For example, the monitoring system 112 may send (e.g., on a scheduled basis, on an on-demand basis, on a triggered basis, or on an ad-hoc basis) a request to the gateway device 108 for the sensor data, and the gateway device 108, in response to the request, may send the sensor data to the monitoring system 112. Alternatively, the gateway device 108 may send the sensor data to the monitoring system 112 as part of a "push" operation. For example, the gateway device 108 may send the sensor data to the monitoring system 112 on a scheduled basis, on an on-demand basis, on a triggered basis, or on an ad-hoc basis.

In some implementations, the monitoring system 112 may maintain sensor device information that identifies the plurality of sensor devices 102. For example, the monitoring system 112 may store the sensor device information in a data structure (e.g., that is included in the monitoring system 112 and/or accessible to the monitoring system 112). The sensor device information may indicate, for a particular sensor device 102, of the plurality of sensor devices 102, an identifier (e.g., a character string, a number, and/or other identifier) associated with the particular sensor device; a vendor associated with the particular sensor device; a type of the particular sensor device; a physical location of the particular sensor device within the physical environment; and/or a sensor group associated with the particular sensor device; among other examples. Accordingly, the monitoring system 112 may identify the plurality of sensor devices 102 that are associated with the physical environment by communicating with the data structure to obtain the sensor device information.

In some implementations, the monitoring system 112 may identify one or more virtual sensors that are associated with the physical environment. A virtual sensor may be associated with a particular set of sensor devices 102 (e.g., that comprises two or more sensor devices 102) of the plurality of sensor devices 102 and may be configured to measure one or more attributes of the physical environment (e.g., based on measurements captured by the particular set of sensor devices). In some implementations, a virtual sensor may measure an attribute of the physical environment that is not directly measured by the set of sensor devices 102, but that can be determined by processing sensor data captured by the set of sensor devices 102. For example, when the set of sensor devices 102 includes a thermometer that measures a temperature of a location within the physical environment and a humidistat that measures a humidity of the location, a virtual sensor may be set up to compute a heat index of the location (e.g., how the location feels to an occupant of the location) based on the temperature and the humidity of the location.

In some implementations, the monitoring system 112 may maintain virtual sensor information that identifies the one or more virtual sensors associated with the physical environment. For example, the monitoring system 112 may store the virtual sensor device information in a data structure (e.g., the same data structure described above or a different data structure that is included in the monitoring system 112 and/or accessible to the monitoring system 112). The virtual sensor information may indicate, for a particular virtual sensor, of one or more virtual sensors, an identifier (e.g., a character string, a number, and/or other identifier) associated with the particular virtual sensor; a vendor or list of vendors associated with the particular virtual sensor; a type of the particular virtual sensor; a physical location within the physical environment that is associated with the particular virtual sensor; a sensor group associated with the particular virtual sensor; one or more attributes of the physical environment that the virtual sensor is to measure; a set of sensor devices 102 that are associated with the particular virtual sensor; and/or information related to measuring the one or more attributes based on sensor data obtained by the set of sensor devices 102 (e.g., information that identifies one or more algorithms for processing the sensor data obtained by the set of sensor devices 102); among other examples. Accordingly, the monitoring system 112 may identify the one or more virtual sensors that are associated with the physical environment by communicating with the data structure to obtain the virtual sensor information.

Figure 1C:
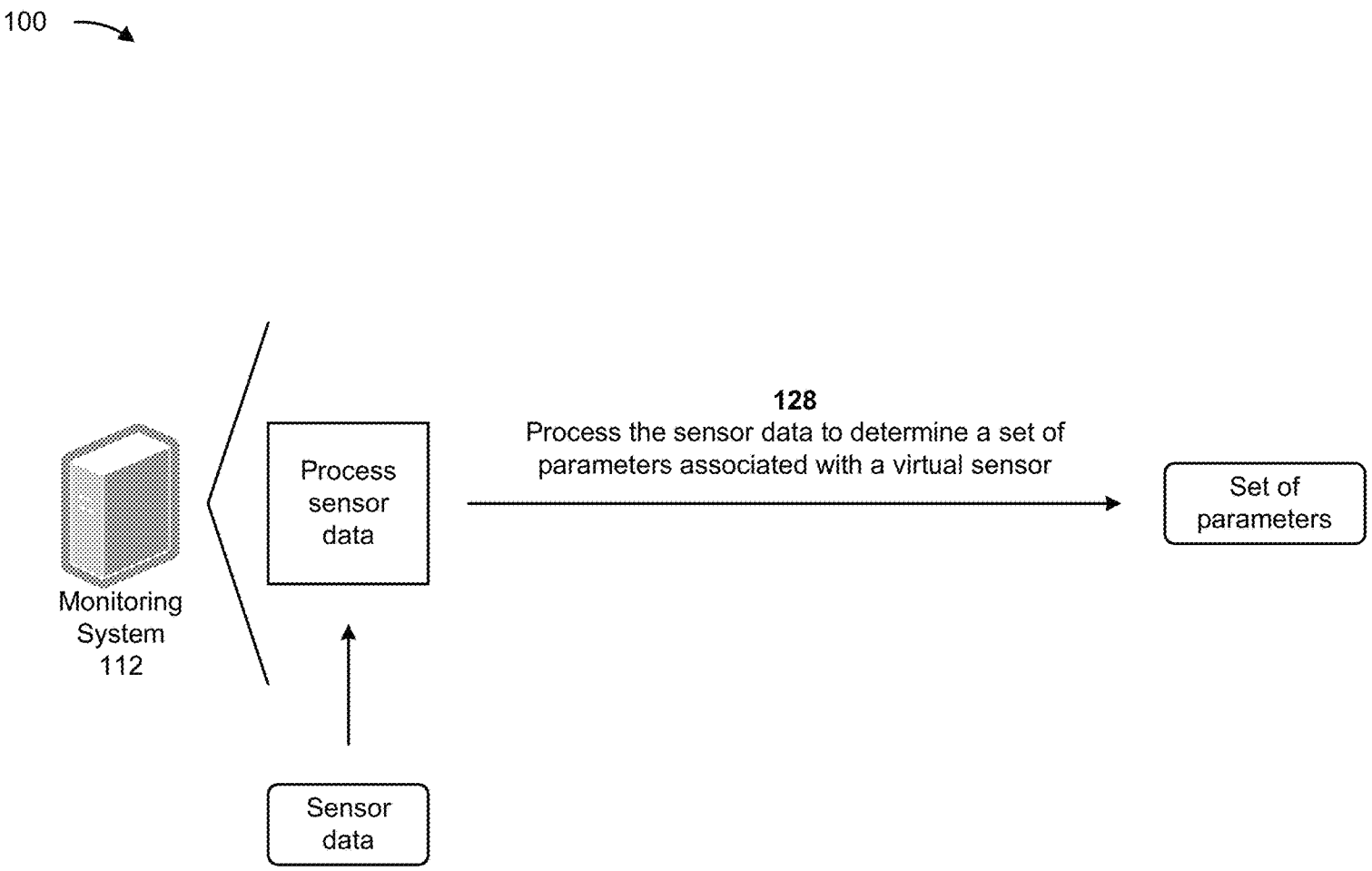

As shown in FIG. 1C, and by reference number 128, the monitoring system 112 may process the sensor data that was captured by the plurality of sensor devices 102 and that was provided to the monitoring system 112 via the one or more data collector devices 104, the one or more CPEs 106, and/or the gateway device 108 (e.g., as described herein in relation to FIGS. 1A-1B). In some implementations, the monitoring system 112 may process the sensor data to determine a set of parameters associated with a virtual sensor of the one or more virtual sensors. The set of parameters may indicate a set of measurements associated with one or more attributes of the physical environment (e.g., that the virtual sensor is configured to measure).

In some implementations, the monitoring system 112 may identify a set of sensor data, of the sensor data, that was captured by a set of sensor devices 102 that are associated with the virtual sensor and may process the set of sensor data to determine the set of parameters associated with the virtual sensor. For example, the monitoring system 112 may identify a set of sensor data that was captured by a first sensor device and a second sensor device that are associated with a virtual sensor and may process the set of sensor data to determine the set of parameters associated with the virtual sensor. Additionally, or alternatively, the monitoring system 112 may identify a subset of the set of sensor data that is related to the one or more attributes of the physical environment that the virtual sensor is to measure and may process the subset of the set of sensor data to determine the set of parameters. For example, when the first sensor device is configured to capture sensor data associated with attribute A and attribute B and the second sensor device is configured to capture sensor data associated with attribute C and attribute D, the set of sensor data may include information related to attributes A-D. The set of parameters associated with the virtual sensor may be based on attributes A and C, so the monitoring system 112 may identify a subset of the set of sensor data that is related to attributes A and C and may process the subset of the set of sensor data to determine the one or more parameters.

Figure 1D:
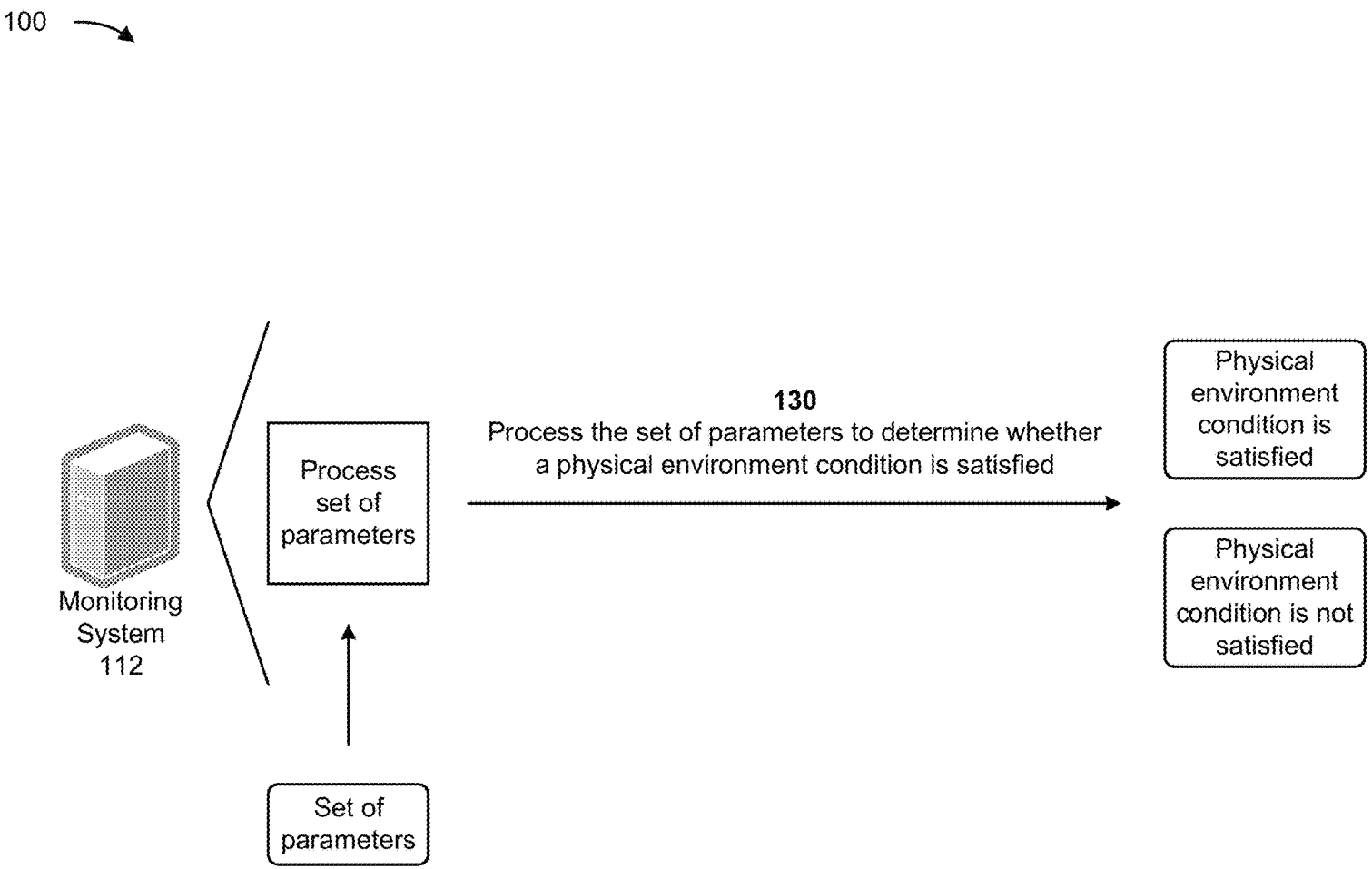

As shown in FIG. 1D, and by reference number 130, the monitoring system 112 may process the set of parameters to determine whether a physical environment condition is satisfied. In some implementations, to determine whether the physical environment condition is satisfied, the monitoring system 112 may identify, based on the set of parameters, a measurement associated with an attribute of the physical environment and may determine whether the measurement satisfies a measurement threshold associated with the attribute. Accordingly, based on determining whether the measurement satisfies the measurement threshold, the monitoring system 112 may determine whether the physical environment condition is satisfied.

In some implementations, the monitoring system 112 may use a machine learning model to process the set of parameters to determine whether the physical environment condition is satisfied. The machine learning model may have been trained based on training data that may include example sets of parameters and example determinations of whether the physical environment condition is satisfied. Using the training data as input to the machine learning model, the machine learning model may be trained to identify one or more relationships (e.g., between the example sets of parameters and the example determinations of whether the physical environment condition is satisfied) to determine when the physical environment condition is satisfied. The monitoring system 112 may include a data structure that stores the machine learning model.

In some implementations, the monitoring system 112 may use at least one graph traversal technique to process the set of parameters associated with the virtual sensor to determine whether the physical environment condition is satisfied. For example, the monitoring system 112 may identify, based on the set of parameters, a measurement associated with an attribute of the physical environment and may determine whether the measurement satisfies a measurement threshold associated with the attribute. Based on determining that the measurement satisfies the measurement threshold, the monitoring system 112 may identify (e.g., by processing a graph representing distances between the plurality of sensor devices 102 and/or the one or more virtual sensors) one or more other sensor devices 102 and/or virtual sensors that are near the virtual sensor (e.g., that are within a threshold distance of the virtual sensor). Accordingly, the monitoring system 112 may determine one or more other measurements associated with the one or more other sensor devices 102 and/or virtual sensor and may determine whether the physical environment condition is satisfied based on the measurement and/or the one or more other measurements. For example, when the measurement and the one or more other measurements are related to temperatures of a room (e.g., a cafeteria) at different locations within the room, the monitoring system 112 may process the measurement and the one or more other measurements to determine whether an average temperature of the room satisfies a an average room temperature threshold.

Figure 1E:
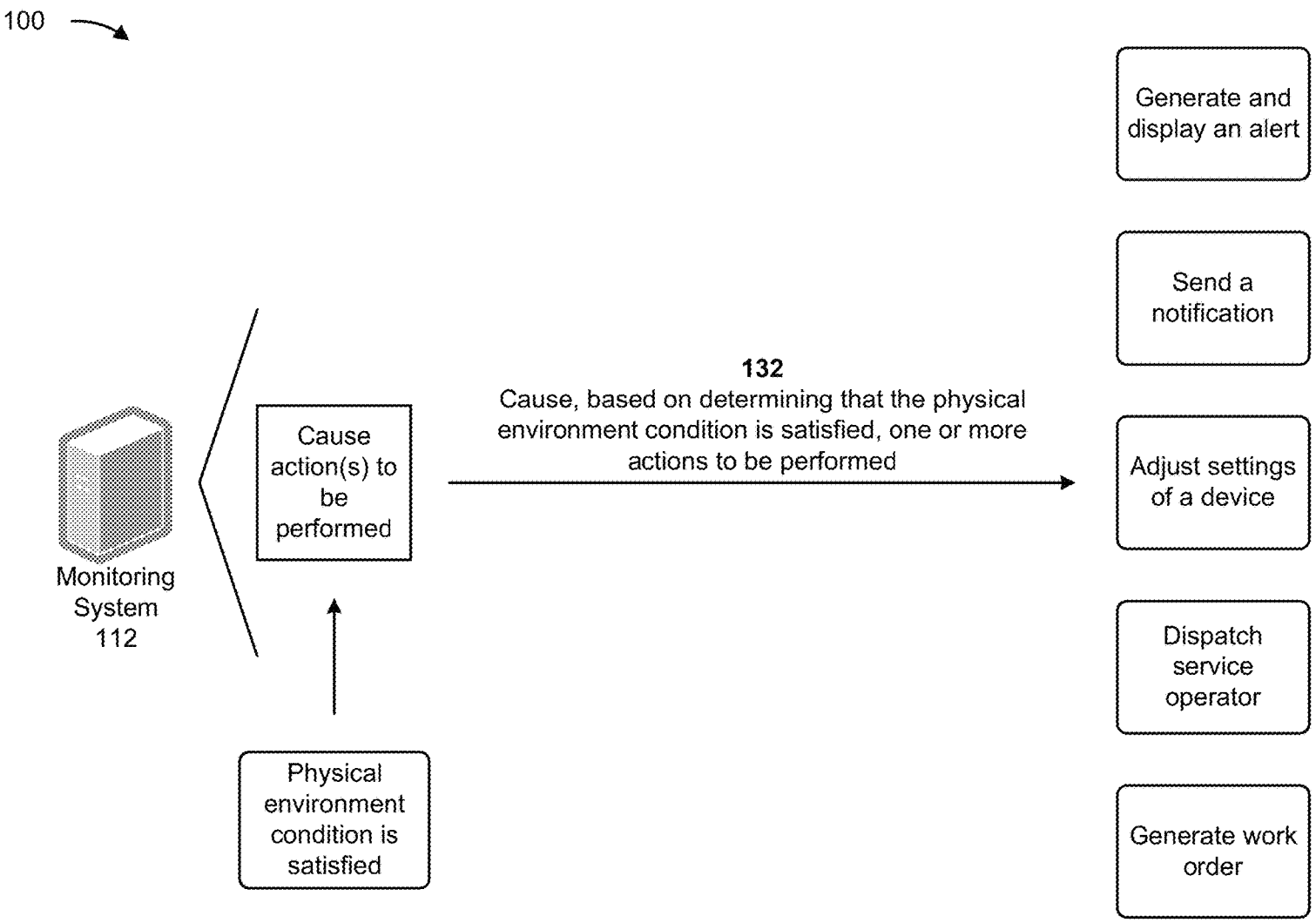

As shown in FIG. 1E, and by reference number 132, the monitoring system 112 may cause, based on determining that the physical environment condition is satisfied, one or more actions to be performed. In some implementations, causing the one or more actions to be performed includes generating an alert indicating that the physical environment condition is satisfied and providing, to the client device 110, an interactive user interface (as further described herein) for display that includes the alert. In some implementations, causing the one or more actions to be performed includes generating a notification indicating that the physical environment condition is satisfied and sending (e.g., to the client device 110) a message that includes the notification. The monitoring system 112 may send the message to an electronic messaging account (e.g., an email account, a text messaging account, an instant messaging account, and/or other messaging account) to cause the client device to display the message (e.g., when the client device runs an application associated with the electronic messaging account). In this way, a user of the client device may quickly and/or efficiently identify and address issues to improve a performance of devices and/or systems of the physical environment that service the physical environment.

In some implementations, causing the one or more actions to be performed includes identifying a device associated with the physical environment condition and automatically causing adjustment of one or more settings of the device. For example, the monitoring system 112 may automatically send a control signal to an air control device to automatically cause adjustment of a temperature setting, a humidity setting, a filtration setting, and/or another setting. In some implementations, causing the one or more actions to be performed includes dispatching a service operator (e.g., by sending a notification, in a similar manner as that described above, to a user device of the service operator) to service the device and/or generating a work order to have the device serviced. In this way, the monitoring system 112 may proactively control and/or cause devices and/or systems associated with the physical environment to be serviced, which reduces usage of resources to reactively control and/or service the devices and/or systems.

Figure 1F:
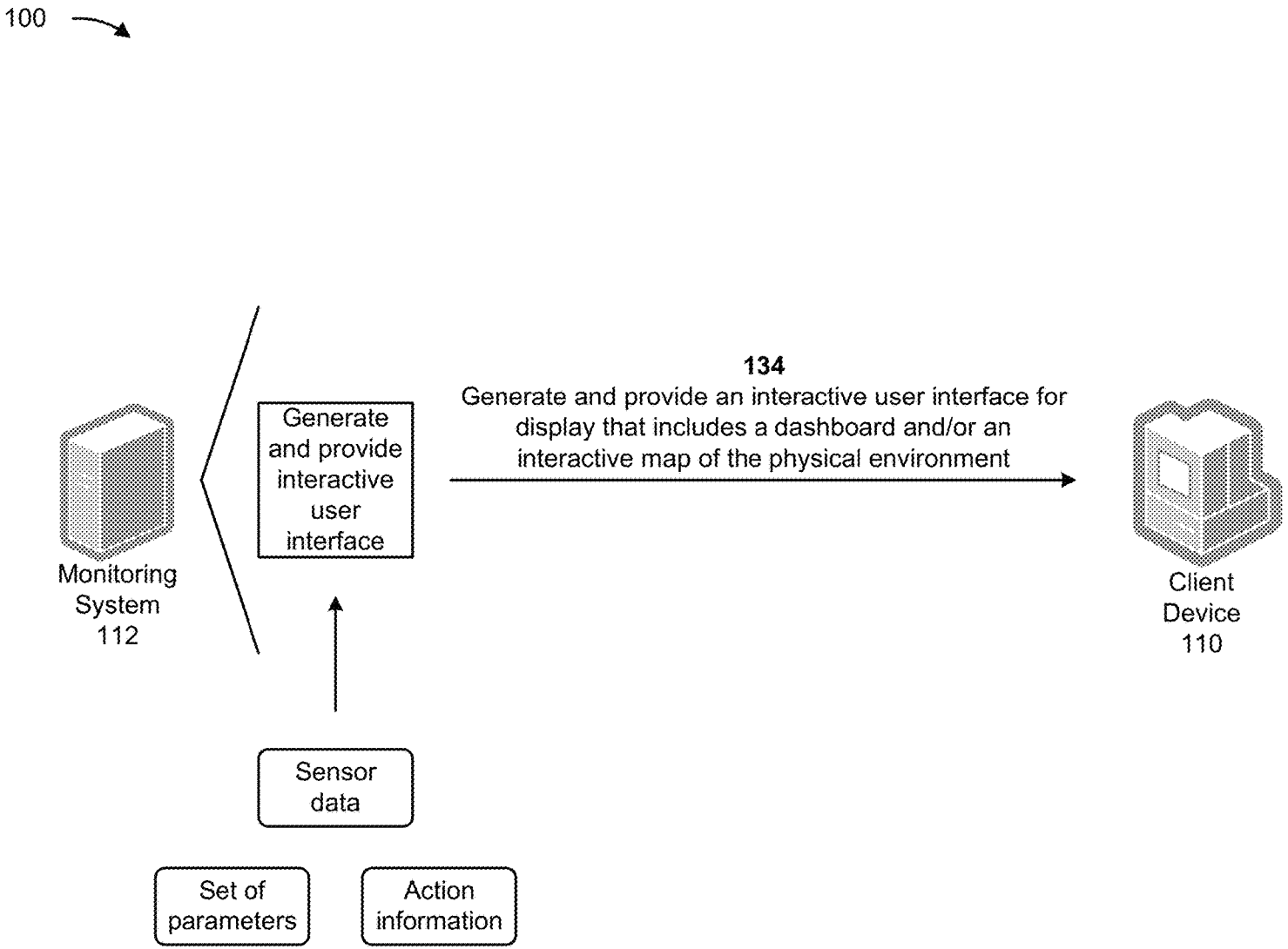

As shown in FIG. 1F, and by reference number 134, the monitoring system 112 may provide an interactive user interface for display on the client device 110 (e.g., on at least one display screen of the client device 110). In some implementations, the interactive user interface includes a dashboard that indicates status information related to at least one sensor device 102, of the plurality of sensor devices 102, and/or at least one virtual sensor of the one or more virtual sensors associated with the physical environment. The status information may indicate, for a sensor device 102, respective measurements associated with one or more attributes of the physical environment that the sensor device 102 is configured to measure (e.g., based on sensor data captured by the sensor device 102). Additionally, or alternatively, the status information may indicate, for a virtual sensor, respective measurements associated with one or more attributes of the physical environment that the virtual sensor is configured to measure (e.g., based on a set of parameters associated with the virtual sensor that are determined by the monitoring system 112 as described herein in relation to FIG. 1C).

In some implementations, the dashboard includes information associated with the one or more actions caused by the monitoring system 112 (e.g., as described in relation to FIG. 1F). For example, the dashboard may include an alert for display (e.g., to the client device 110) that is generated by the monitoring system 112. As another example, the dashboard may include information indicating that settings of a device that were adjusted by the monitoring system 112, that a service operator was dispatched to service the device, and/or that a work order was generated associated with servicing the device, among other examples. Further details regarding the dashboard are described herein in relation to FIG. 2A.

In some implementations, the interactive user interface includes an interactive map of the physical environment. The interactive map may indicate a physical location of at least one sensor device 102, of the plurality of sensor devices 102, within the physical environment and/or a physical location within the physical environment that is associated with at least one virtual sensor of the one or more virtual sensors associated with the physical environment. Further details regarding the dashboard is described herein in relation to FIGS. 2B-2C.

Figure 1G:
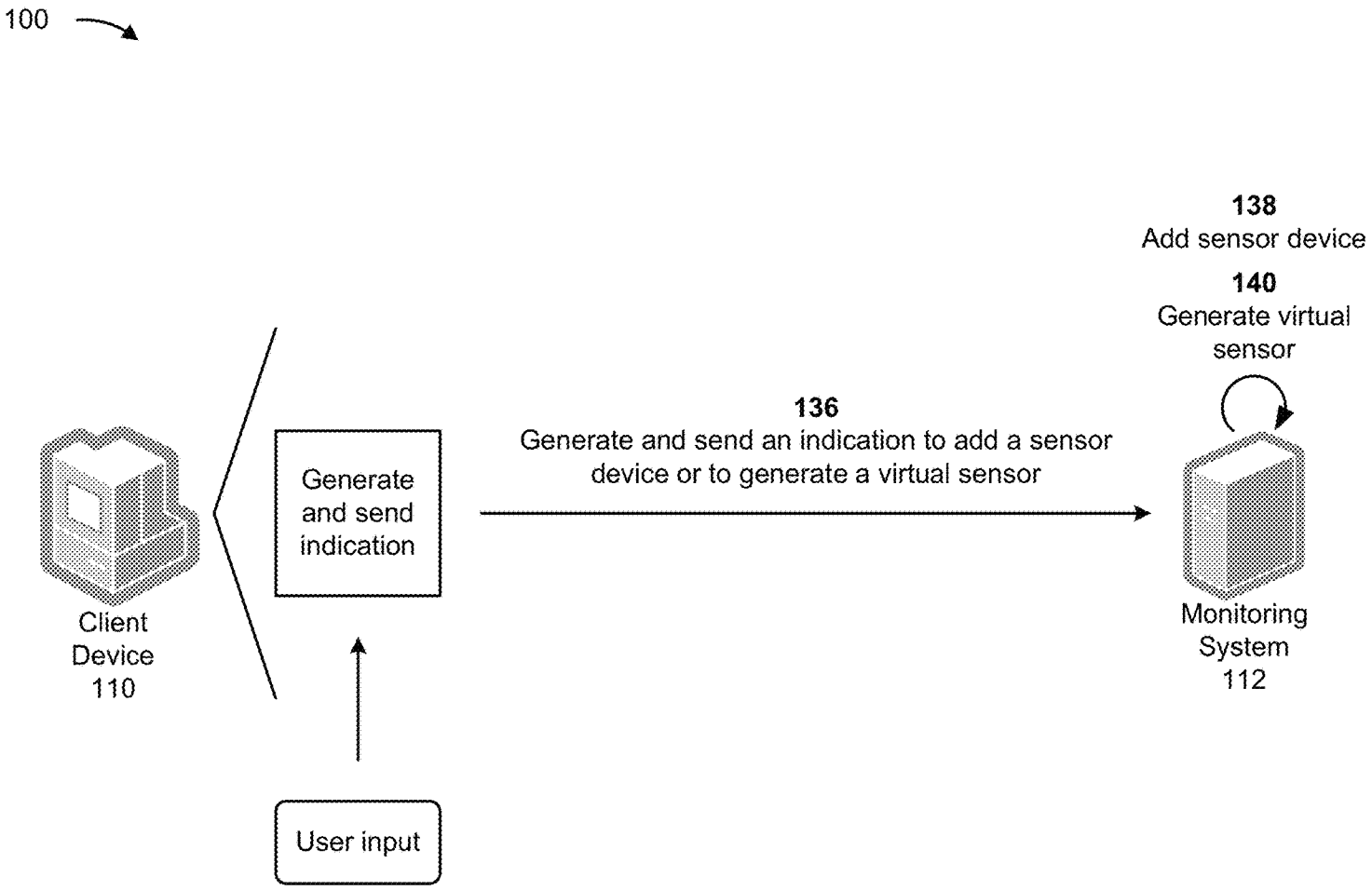

As shown in FIG. 1G, a user of the client device 110 may interact with the interactive user interface to provide user input into the client device 110. For example, the interactive user interface may include a dashboard and an add sensor functionality (e.g., a selectable button on the dashboard) that allows the user to input information regarding a sensor device 102 and/or a virtual sensor associated with the physical environment that are to be monitored by the monitoring system 112. As shown by reference number 136, the client device 110 (e.g., based on the user input) may generate and send, to the monitoring system 112, an indication to add a sensor device 102 or to generate a virtual sensor. For example, when the user input indicates that a sensor device 102 is to be monitored, the indication may include information that indicates an identifier of the sensor device 102, information indicating a type of the sensor device 102, and/or information identifying a sensor group associated with the sensor device 102. As another example, when the user input indicates that a virtual sensor is to be monitored, the indication may include information identifying a set of sensor devices 102 (e.g., two or more sensor devices 102) associated with the virtual sensor; information indicating an identifier of the virtual sensor; information indicating a type of the virtual sensor; information identifying a sensor group associated with the virtual sensor; information indicating a physical location within the physical environment that is associated with the virtual sensor; information identifying one or more attributes of the physical environment that the virtual sensor is to measure; and/or information indicating how the one or more attributes of the physical environment that the virtual sensor is to measure are related to respective sets of attributes of the physical environment that the set of sensor devices 102 are configured to measure.

As further shown in FIG. 1G, and by reference number 138, when the indication is to add a sensor device 102, the monitoring system 112 may add the sensor device 102 to the plurality of sensor devices 102 (e.g., based on the indication). For example, the monitoring system 112 may identify the data structure that is configured to store the sensor device information that identifies the plurality of sensor devices 102 and may cause the data structure to store an entry associated with the sensor device 102. The entry may include some or all of the information included in the indication.

As further shown in FIG. 1G, and by reference number 140, when the indication is to generate a virtual sensor, the monitoring system 112 may generate the virtual sensor to the one or more virtual sensors that are associated with the physical environment. For example, the monitoring system 112 may identify the data structure that is configured to store the information that identifies the one or more virtual sensors associated with the physical environment and may cause the data structure to store an entry associated with the virtual sensor. The entry may include some or all of the information included in the indication.

As indicated above, FIGS. 1A-1G are provided as an example. In practice, there may be additional devices and/or networks, fewer devices and/or networks, different devices and/or networks, or differently arranged devices and/or networks than those shown in FIGS. 1A-1G. Furthermore, two or more devices shown in FIGS. 1A-1G may be implemented within a single device, or a single device shown in FIGS. 1A-1G may be implemented as multiple, distributed devices. For example, a sensor device 102 and a data collector device 104 may be implemented within a single device or as separate devices. Additionally, or alternatively, a set of devices (e.g., one or more devices) of one or more examples 100 may perform one or more functions described as being performed by another set of devices of one or more examples 100.

Figure 2A:
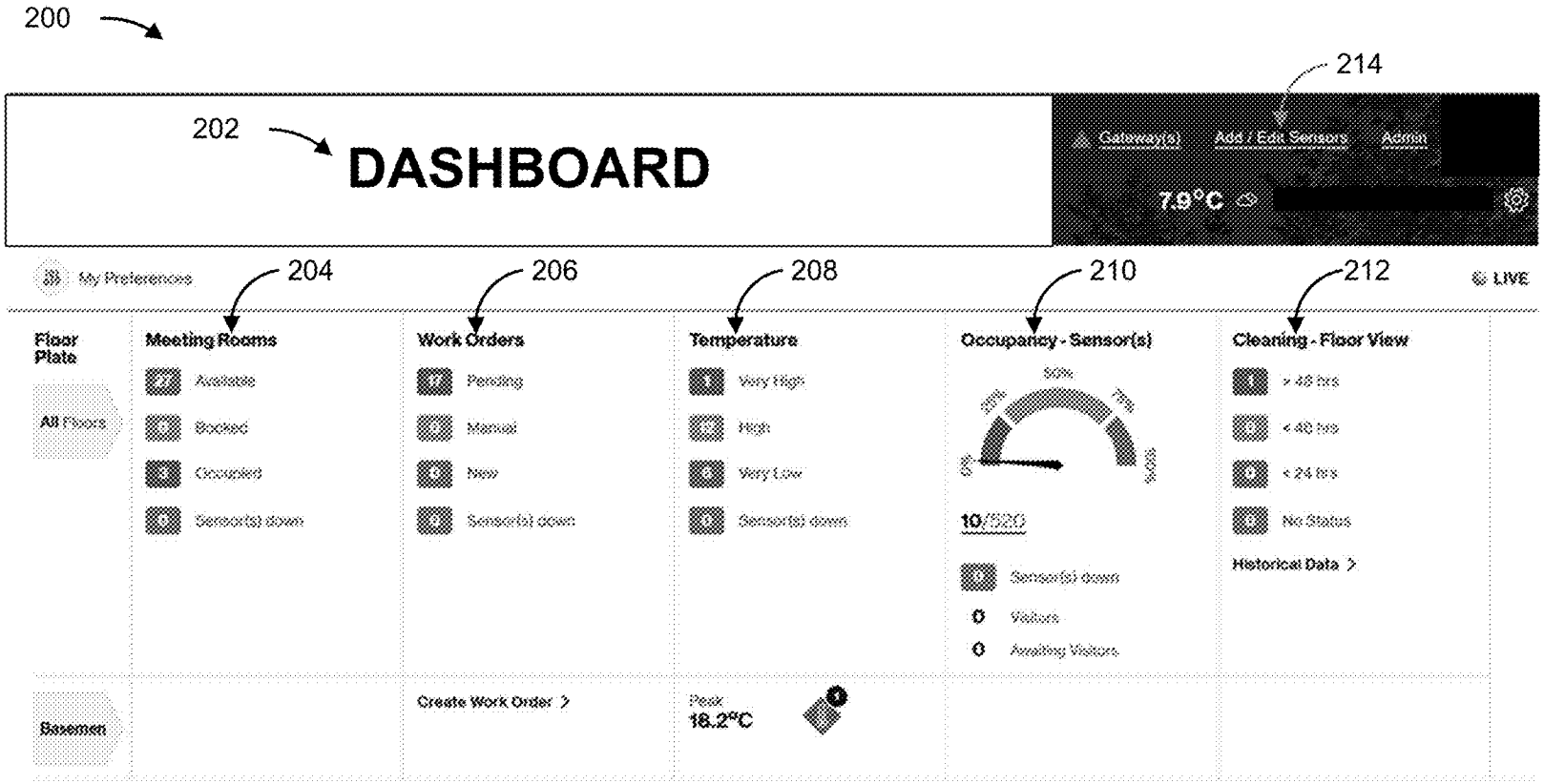
FIGS. 2A-2D are diagrams of one or more examples of an interactive user interface described herein.

FIGS. 2A-2D are example diagrams of an interactive user interface 200 provided by the monitoring system 112 for display (e.g., by the client device 110). FIG. 2A shows an example dashboard 202 of the interactive user interface 200. The dashboard 202 may indicate status information related to at least one sensor device 102, of the plurality of sensor devices 102, and/or at least one virtual sensor of the one or more virtual sensors associated with a physical environment (e.g., an office building). For example, as shown in FIG. 2A, the dashboard 202 may include occupancy status information 204 regarding meeting rooms of the physical environment, progress status information 206 regarding work orders (e.g., that are related to attributes of the physical environment that are measured by the plurality of sensor devices 102 and/or the one or more virtual sensors), temperature status information 208 related to different locations of the physical environment, occupancy status information 210 regarding the entire physical environment, and/or cleanliness status 212 of the physical environment. As further shown in FIG. 2A, the dashboard 202 may include an add sensor functionality 214 (e.g., as described herein in relation to FIG. 1G).

Figure 2B:
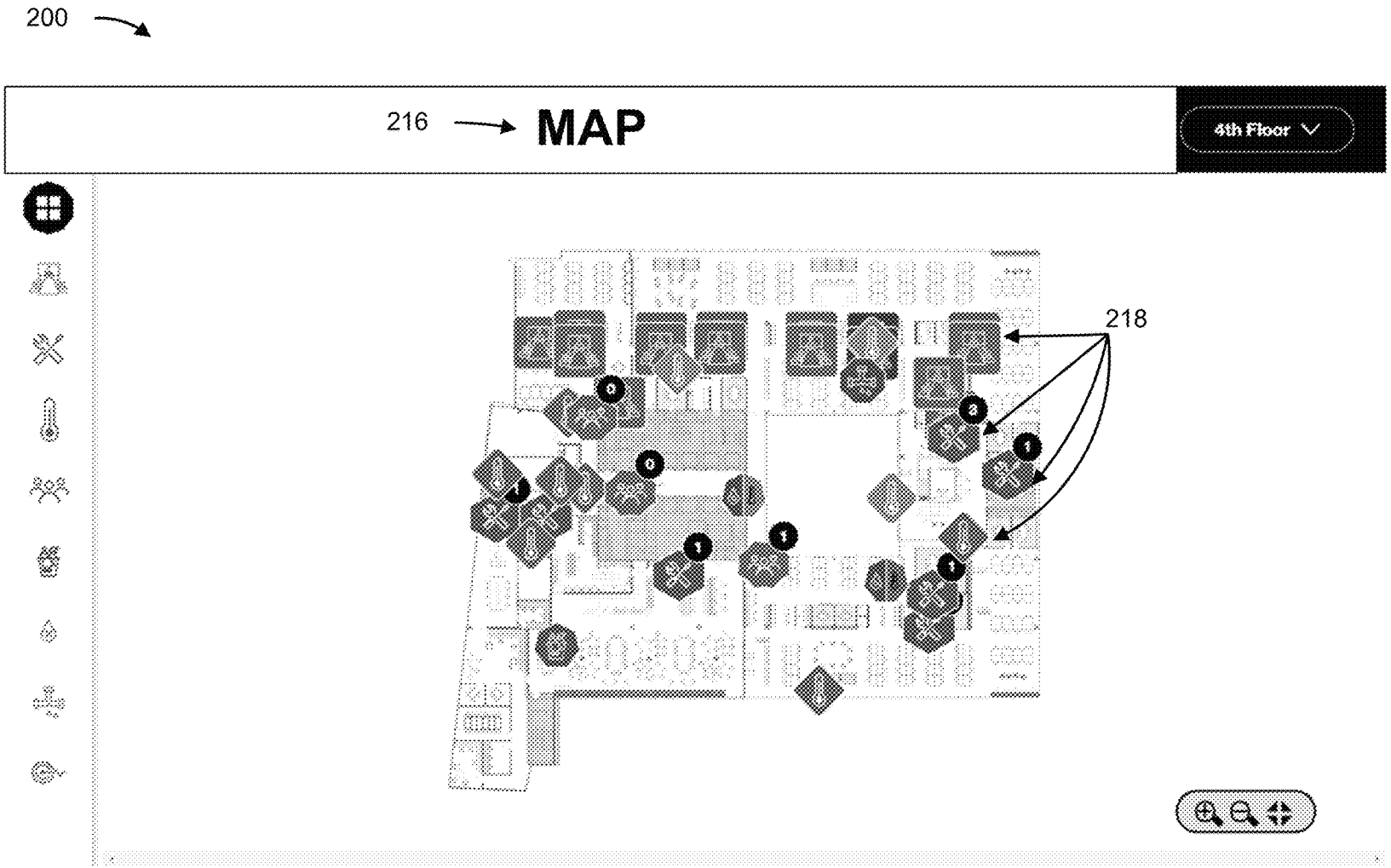
Figure 2C:
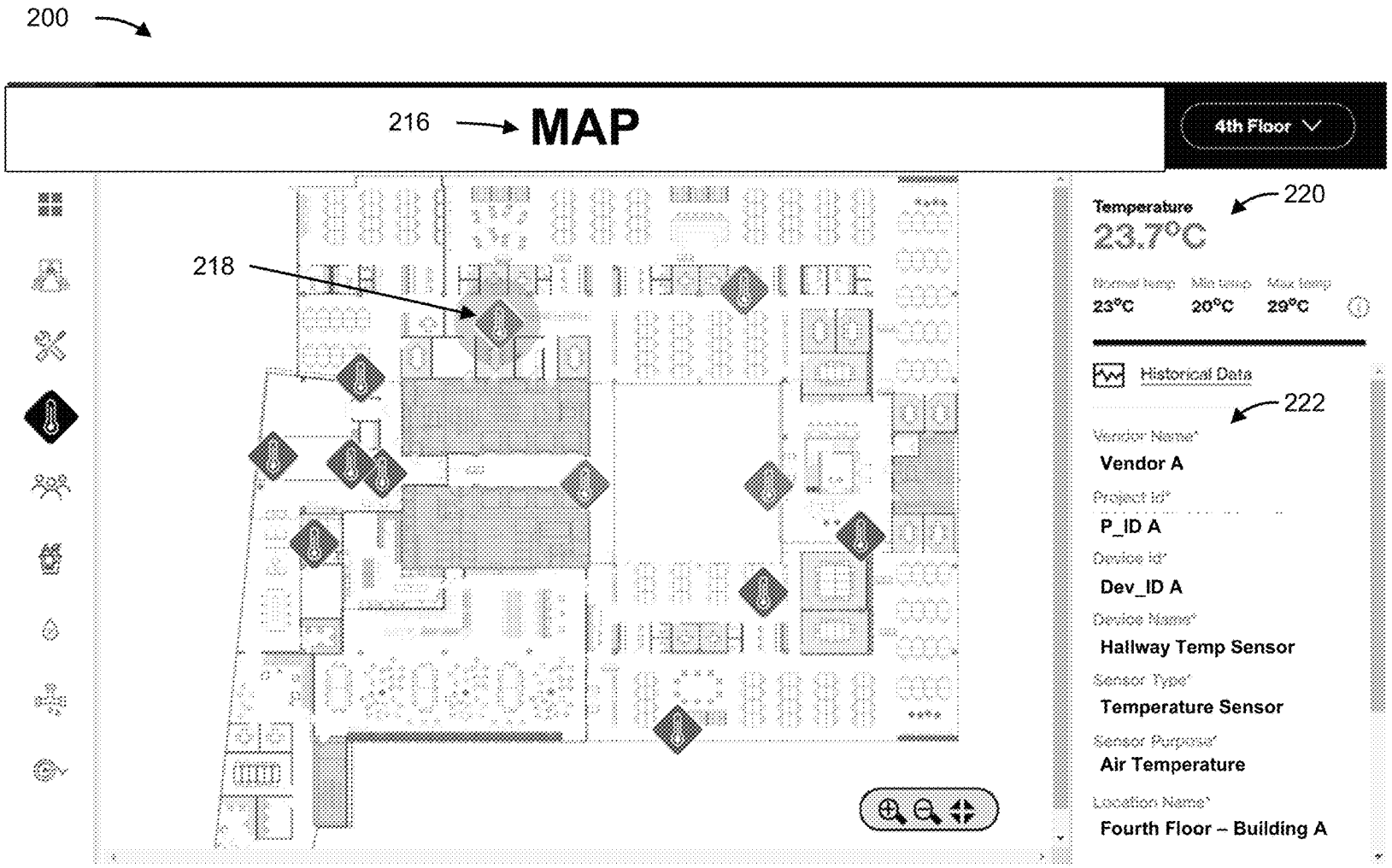

FIGS. 2B-2C show an example interactive map 216 of the interactive user interface 200. The interactive map may indicate a physical location of at least one sensor device 102, of the plurality of sensor devices 102, within the physical environment and/or a physical location within the physical environment that is associated with at least one virtual sensor of the one or more virtual sensors associated with the physical environment. For example, as shown in FIG. 2B, the interactive map 216 may include one or more icons 218 that indicate the physical location of the at least one sensor device 102 within the physical environment and/or the physical location within the physical environment that is associated with the at least one virtual sensor. In some implementations, an icon 218, of the one or more icons 218, may indicate a type, a sensor group, or other identifying information of the sensor device 102 or the virtual sensor associated with the icon 218.

As shown in FIG. 2C, a user of the client device 110 may interact with the interactive map 216 to select an icon 218, of the one or more icons 218, which may cause the interactive map 216 and/or the interactive user interface 200 to display primary information 220 and/or additional information 222 related to the sensor device 102 or the virtual sensor associated with the icon 218. The primary information 220 may include, for example, as shown in FIG. 2C, a current measurement (e.g., a temperature of 23.7° Celsius) of an attribute that the sensor device 102 or the virtual sensor is configured to measure and/or other measurements of the attribute (e.g., a minimum measurement, a maximum measurement, and/or an average measurement, among other examples, of the attribute over a period of time, such as 1 hour, 12 hours, or 24 hours). The additional information 222 may include, for example, at least one identifier associated with the sensor device 102 or the virtual sensor identifier (e.g., a Device ID of Dev_ID_A and a Device Name of Hallway Temp Sensor); at least one vendor associated with the sensor device 102 or the virtual sensor (e.g., a Vendor Name of Vendor A); at least one type of the sensor device 102 or the virtual sensor (e.g., a Sensor Type of Temperature Sensor); a physical location of the sensor device 102 or the virtual sensor within the physical environment (e.g., a Location Name of Fourth Floor—Building A); and/or at least one sensor group associated with the sensor device 102 or the virtual sensor (e.g. a Project ID of P_ID_A).

Figure 2D:
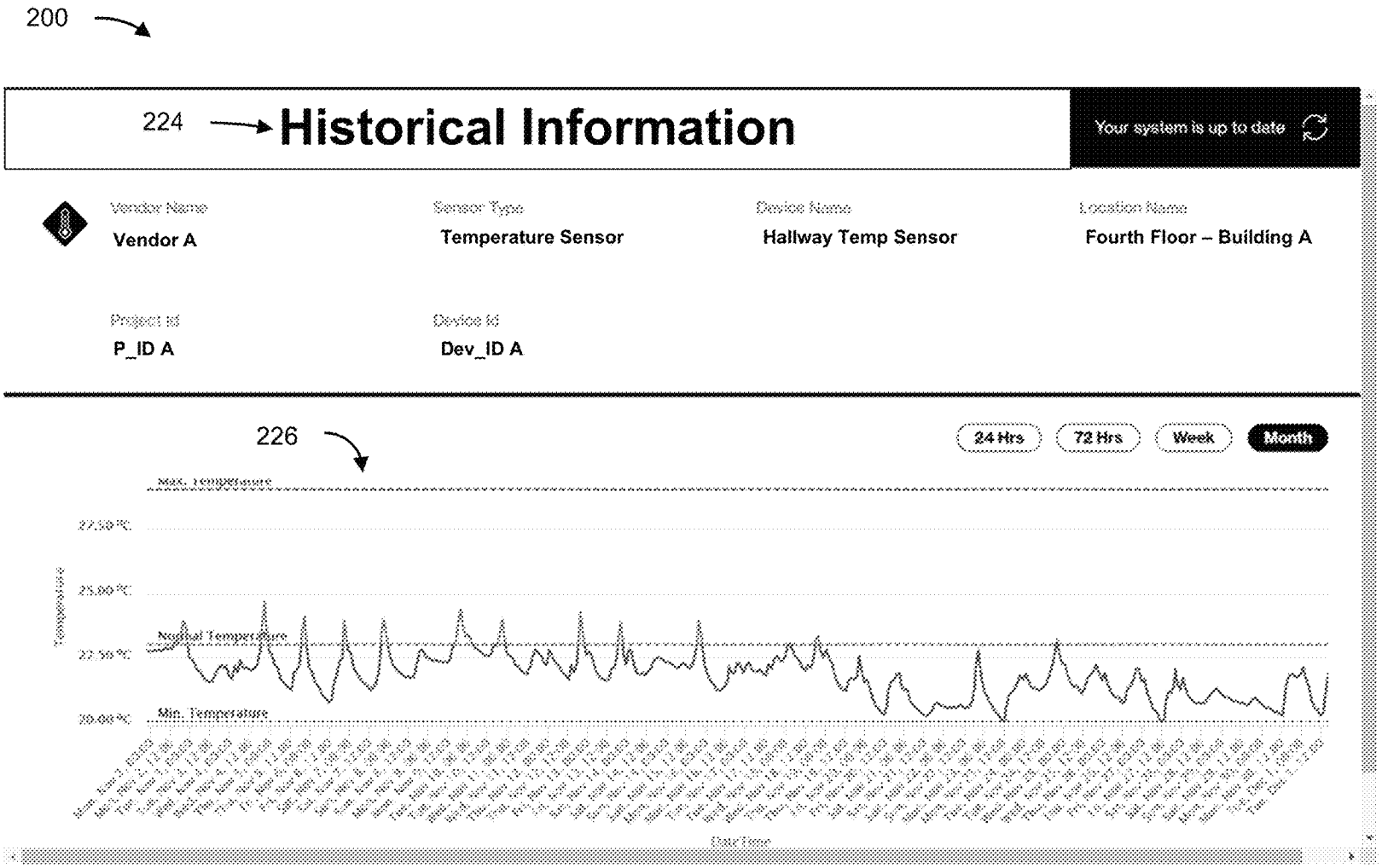

As shown in FIG. 2D, a user of the client device 110 may interact with the interactive map 216 and/or the dashboard 202 to select an icon 218, of the one or more icons 218, which may cause the interactive user interface 200 to display historical information 224 related to the sensor device 102 or the virtual sensor associated with the icon 218. The historical information 224 may include, for example, as shown in FIG. 2D, measurements 226 of an attribute that the sensor device 102 or the virtual sensor is configured to measure over a period of time, such as 24 hours, 72 hours, a week, or a month. The interactive user interface 200 may display the primary information 220 and/or the additional information 222 when displaying the historical information 224.

As indicated above, FIGS. 2A-2D are provided as an example. Other examples may differ from what is described in connection with FIGS. 2A-2D.

Figure 3:
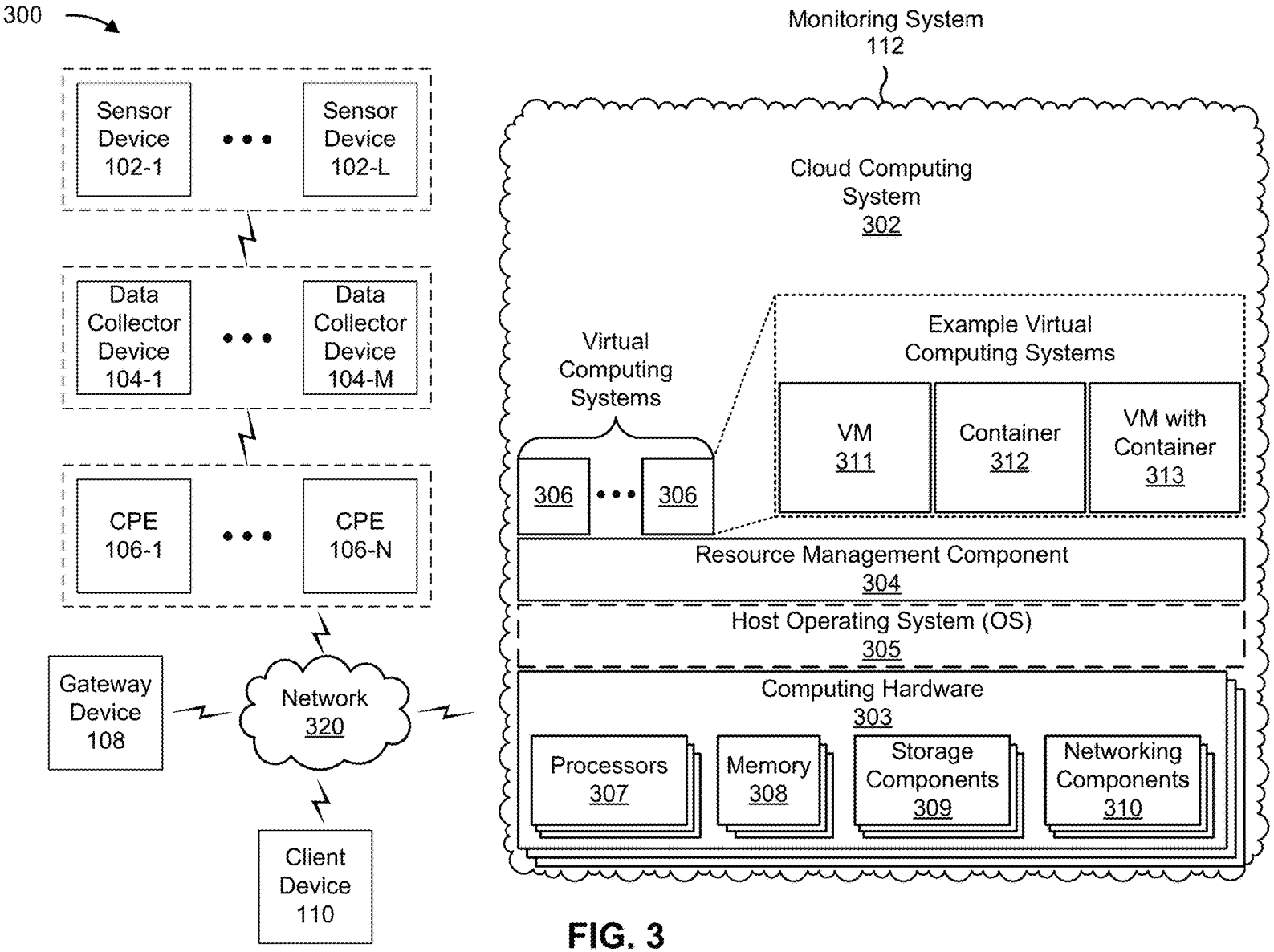
FIG. 3 is a diagram of an example environment in which systems and/or methods described herein may be implemented.

FIG. 3 is a diagram of an example environment 300 in which systems and/or methods described herein may be implemented. As shown in FIG. 3, environment 300 may include the plurality of sensor devices 102 (shown as sensor devices 102-1 through 102-L, where L≥2), the one or more data collector devices 104 (shown as data collector devices 104-1 through 104-M, where M≥1), the one or more CPEs (shown as CPE 106-1 through 106-N, where N≥1), the gateway device 108, the client device 110, and/or the monitoring system 112. As shown in FIG. 3, the monitoring system 112 may include one or more elements of and/or may execute within a cloud computing system 302. The cloud computing system 302 may include one or more elements 303-313, as described in more detail below. As further shown in FIG. 3, environment 300 may include a network 320. Devices and/or elements of environment 300 may interconnect via wired connections and/or wireless connections.

A sensor device 102 includes one or more devices capable of receiving, generating, storing, processing, and/or providing sensor data, such as sensor data described herein. The sensor device 102 may include a sensor to measure one or more attributes of the physical environment, such as an amount of sunlight, an air temperature level, a humidity level, an oxygen level, a carbon monoxide level, a moisture level, a wind level, a presence of water, a device usage, and/or a door usage, among other examples, of the physical environment. In some implementations, the sensor device 102 may be an Internet-of-things (IoT) device. The sensor device 102 may be configured to provide sensor data to a data collector device 104 of the one or more data collector devices 104.

A data collector device 104 includes one or more devices capable of receiving, generating, storing, processing, and/or providing sensor data, such as sensor data described herein. In some implementations, the data collector device 104 may comprise a hub, a bridge, or other collector device for obtaining sensor data from a set of sensor devices 102 of the plurality of sensor devices 102. The data collector device 104 may be configured to provide sensor data to a CPE 106 of the one or more CPEs 106.

A CPE 106 includes one or more devices capable of receiving, generating, storing, processing, and/or providing sensor data, such as sensor data described herein. For example, the CPE 106 may include a multi-function networking device that may combine the functions of a Digital Subscriber Line (DSL) or cable modem, a cellular modem (e.g., a long term evolution (LTE) modem, a 5G modem, a 5G mmW modem, and/or the like), a firewall, a router, a network switch, and/or a wireless access point into a single device. The CPE 106 may employ one or more short-range wireless communication protocols for a wireless personal area network (WPAN) and/or a wireless local area network (WLAN), such as, for example, IEEE 802.15 (e.g., Bluetooth) and IEEE 802.11 (e.g., Wi-Fi). Alternatively, or additionally, different short-range wireless protocols and/or frequencies may be used by the CPE 106. The CPE 106 may also include one or more wired (e.g., Ethernet) connections. The CPE 106 may be configured to provide sensor data to the gateway device 108 (e.g., via the network 320).

The gateway device 108 includes one or more devices capable of receiving, generating, storing, processing, and/or providing sensor data, such as sensor data described herein. The gateway device 108 may include a communication device and/or a computing device. For example, the gateway device 108 may include a server, such as an application server, a client server, a web server, a database server, a host server, a proxy server, a virtual server (e.g., executing on computing hardware), or a server in a cloud computing system. In some implementations, the gateway device 108 includes computing hardware used in a cloud computing environment. The gateway device 108 may be configured to provide sensor data to the monitoring system 112 (e.g., via the network 320).

The client device 110 includes one or more devices capable of receiving, generating, storing, processing, and/or providing information associated with monitoring a physical environment, as described elsewhere herein. The client device 110 may include a communication device and/or a computing device. For example, the client device 110 may include a wireless communication device, a mobile phone, a user equipment, a laptop computer, a tablet computer, a desktop computer, a wearable communication device (e.g., a smart wristwatch, a pair of smart eyeglasses, a head mounted display, or a virtual reality headset), or a similar type of device. The client device 110 may display an interactive user interface provided by the monitoring system 112 to facilitate monitoring of the physical environment.

The monitoring system 112 may include one or more elements of and/or may execute within the cloud computing system 302. The cloud computing system 302 includes computing hardware 303, a resource management component 304, a host operating system (OS) 305, and/or one or more virtual computing systems 306. The cloud computing system 302 may execute on, for example, an Amazon Web Services platform, a Microsoft Azure platform, or a Snowflake platform. The resource management component 304 may perform virtualization (e.g., abstraction) of computing hardware 303 to create the one or more virtual computing systems 306. Using virtualization, the resource management component 304 enables a single computing device (e.g., a computer or a server) to operate like multiple computing devices, such as by creating multiple isolated virtual computing systems 306 from computing hardware 303 of the single computing device. In this way, computing hardware 303 can operate more efficiently, with lower power consumption, higher reliability, higher availability, higher utilization, greater flexibility, and lower cost than using separate computing devices.

Computing hardware 303 includes hardware and corresponding resources from one or more computing devices. For example, computing hardware 303 may include hardware from a single computing device (e.g., a single server) or from multiple computing devices (e.g., multiple servers), such as multiple computing devices in one or more data centers. As shown, computing hardware 303 may include one or more processors 307, one or more memories 308, one or more storage components 309, and/or one or more networking components 310. Examples of a processor, a memory, a storage component, and a networking component (e.g., a communication component) are described elsewhere herein.

The resource management component 304 includes a virtualization application (e.g., executing on hardware, such as computing hardware 303) capable of virtualizing computing hardware 303 to start, stop, and/or manage one or more virtual computing systems 306. For example, the resource management component 304 may include a hypervisor (e.g., a bare-metal or Type 1 hypervisor, a hosted or Type 2 hypervisor, or another type of hypervisor) or a virtual machine monitor, such as when the virtual computing systems 306 are virtual machines 311. Additionally, or alternatively, the resource management component 304 may include a container manager, such as when the virtual computing systems 306 are containers 312. In some implementations, the resource management component 304 executes within and/or in coordination with a host operating system 305.

A virtual computing system 306 includes a virtual environment that enables cloud-based execution of operations and/or processes described herein using computing hardware 303. As shown, a virtual computing system 306 may include a virtual machine 311, a container 312, or a hybrid environment 313 that includes a virtual machine and a container, among other examples. A virtual computing system 306 may execute one or more applications using a file system that includes binary files, software libraries, and/or other resources required to execute applications on a guest operating system (e.g., within the virtual computing system 306) or the host operating system 305.

Although the monitoring system 112 may include one or more elements 303-313 of the cloud computing system 302, may execute within the cloud computing system 302, and/or may be hosted within the cloud computing system 302, in some implementations, the monitoring system 112 may not be cloud-based (e.g., may be implemented outside of a cloud computing system) or may be partially cloud-based. For example, the monitoring system 112 may include one or more devices that are not part of the cloud computing system 302, such as device 400 of FIG. 4, which may include a standalone server or another type of computing device. The monitoring system 112 may perform one or more operations and/or processes described in more detail elsewhere herein. For example, the monitoring system 112 may provide an interactive user interface for display on the client device 110.

Network 320 includes one or more wired and/or wireless networks. For example, network 320 may include a cellular network, a public land mobile network (PLMN), a local area network (LAN), a wide area network (WAN), a private network, the Internet, and/or a combination of these or other types of networks. The network 320 enables communication among the devices of environment 300.

The number and arrangement of devices and networks shown in FIG. 3 are provided as an example. In practice, there may be additional devices and/or networks, fewer devices and/or networks, different devices and/or networks, or differently arranged devices and/or networks than those shown in FIG. 3. Furthermore, two or more devices shown in FIG. 3 may be implemented within a single device, or a single device shown in FIG. 3 may be implemented as multiple, distributed devices. Additionally, or alternatively, a set of devices (e.g., one or more devices) of environment 300 may perform one or more functions described as being performed by another set of devices of environment 300.

Figure 4:
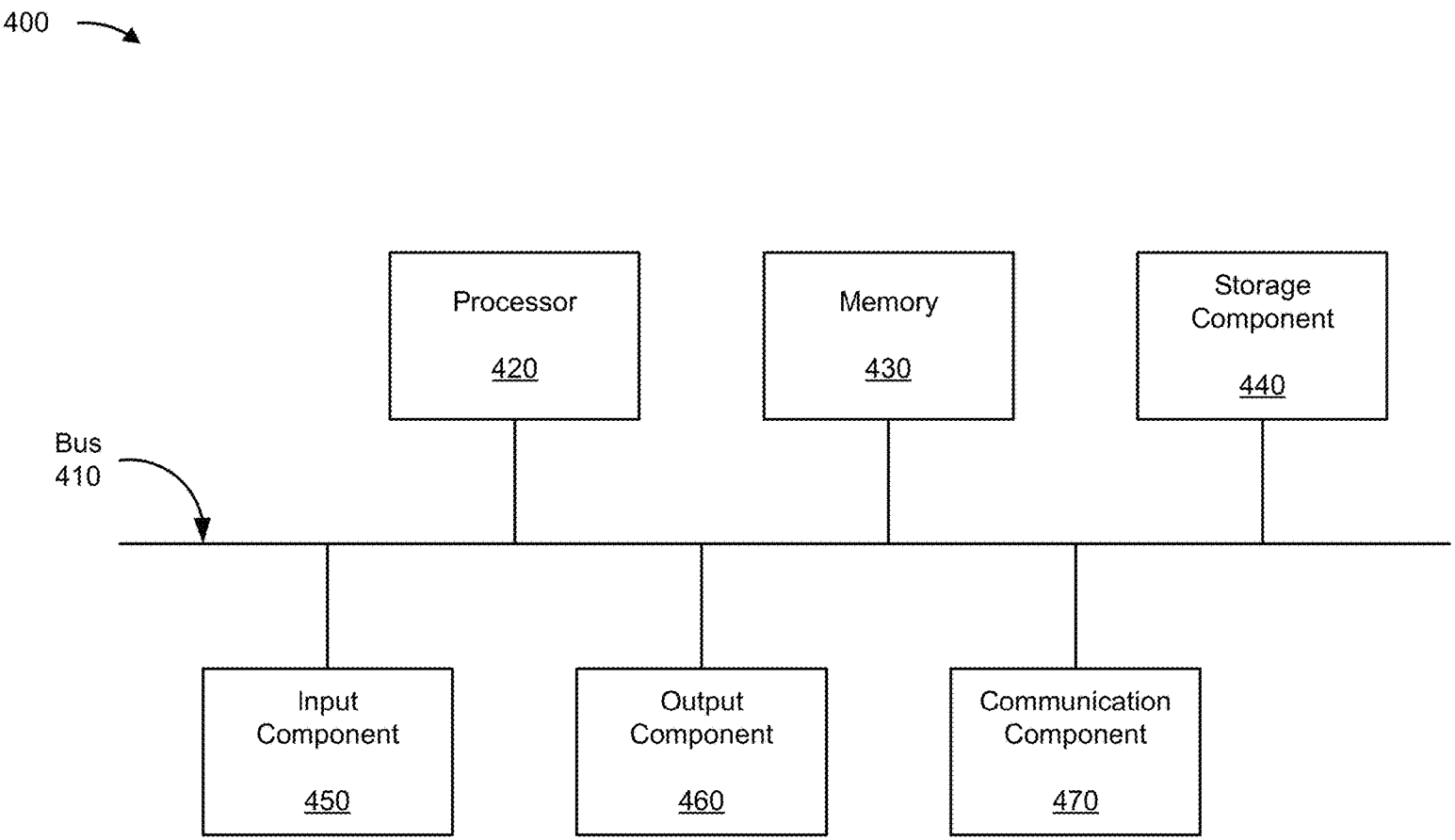
FIG. 4 is a diagram of example components of one or more devices of FIG. 3.

FIG. 4 is a diagram of example components of a device 400, which may correspond to the plurality of sensor devices 102, the one or more data collector devices 104, the one or more CPEs 106, the gateway device 108, the client device 110, the monitoring system 112, and/or the computing hardware 303. In some implementations, the plurality of sensor devices 102, the one or more data collector devices 104, the one or more CPEs 106, the gateway device 108, the client device 110, the monitoring system 112, and/or the computing hardware 303 may include one or more devices 400 and/or one or more components of device 400. As shown in FIG. 4, device 400 may include a bus 410, a processor 420, a memory 430, a storage component 440, an input component 450, an output component 460, and a communication component 470.

Bus 410 includes a component that enables wired and/or wireless communication among the components of device 400. Processor 420 includes a central processing unit, a graphics processing unit, a microprocessor, a controller, a microcontroller, a digital signal processor, a field-programmable gate array, an application-specific integrated circuit, and/or another type of processing component. Processor 420 is implemented in hardware, firmware, or a combination of hardware and software. In some implementations, processor 420 includes one or more processors capable of being programmed to perform a function. Memory 430 includes a random access memory, a read only memory, and/or another type of memory (e.g., a flash memory, a magnetic memory, and/or an optical memory).

Storage component 440 stores information and/or software related to the operation of device 400. For example, storage component 440 may include a hard disk drive, a magnetic disk drive, an optical disk drive, a solid state disk drive, a compact disc, a digital versatile disc, and/or another type of non-transitory computer-readable medium. Input component 450 enables device 400 to receive input, such as user input and/or sensed inputs. For example, input component 450 may include a touch screen, a keyboard, a keypad, a mouse, a button, a microphone, a switch, a sensor, a global positioning system component, an accelerometer, a gyroscope, and/or an actuator. Output component 460 enables device 400 to provide output, such as via a display, a speaker, and/or one or more light-emitting diodes. Communication component 470 enables device 400 to communicate with other devices, such as via a wired connection and/or a wireless connection. For example, communication component 470 may include a receiver, a transmitter, a transceiver, a modem, a network interface card, and/or an antenna.

Device 400 may perform one or more processes described herein. For example, a non-transitory computer-readable medium (e.g., memory 430 and/or storage component 440) may store a set of instructions (e.g., one or more instructions, code, software code, and/or program code) for execution by processor 420. Processor 420 may execute the set of instructions to perform one or more processes described herein. In some implementations, execution of the set of instructions, by one or more processors 420, causes the one or more processors 420 and/or the device 400 to perform one or more processes described herein. In some implementations, hardwired circuitry may be used instead of or in combination with the instructions to perform one or more processes described herein. Thus, implementations described herein are not limited to any specific combination of hardware circuitry and software.

The number and arrangement of components shown in FIG. 4 are provided as an example. Device 400 may include additional components, fewer components, different components, or differently arranged components than those shown in FIG. 4. Additionally, or alternatively, a set of components (e.g., one or more components) of device 400 may perform one or more functions described as being performed by another set of components of device 400.

Figure 5:
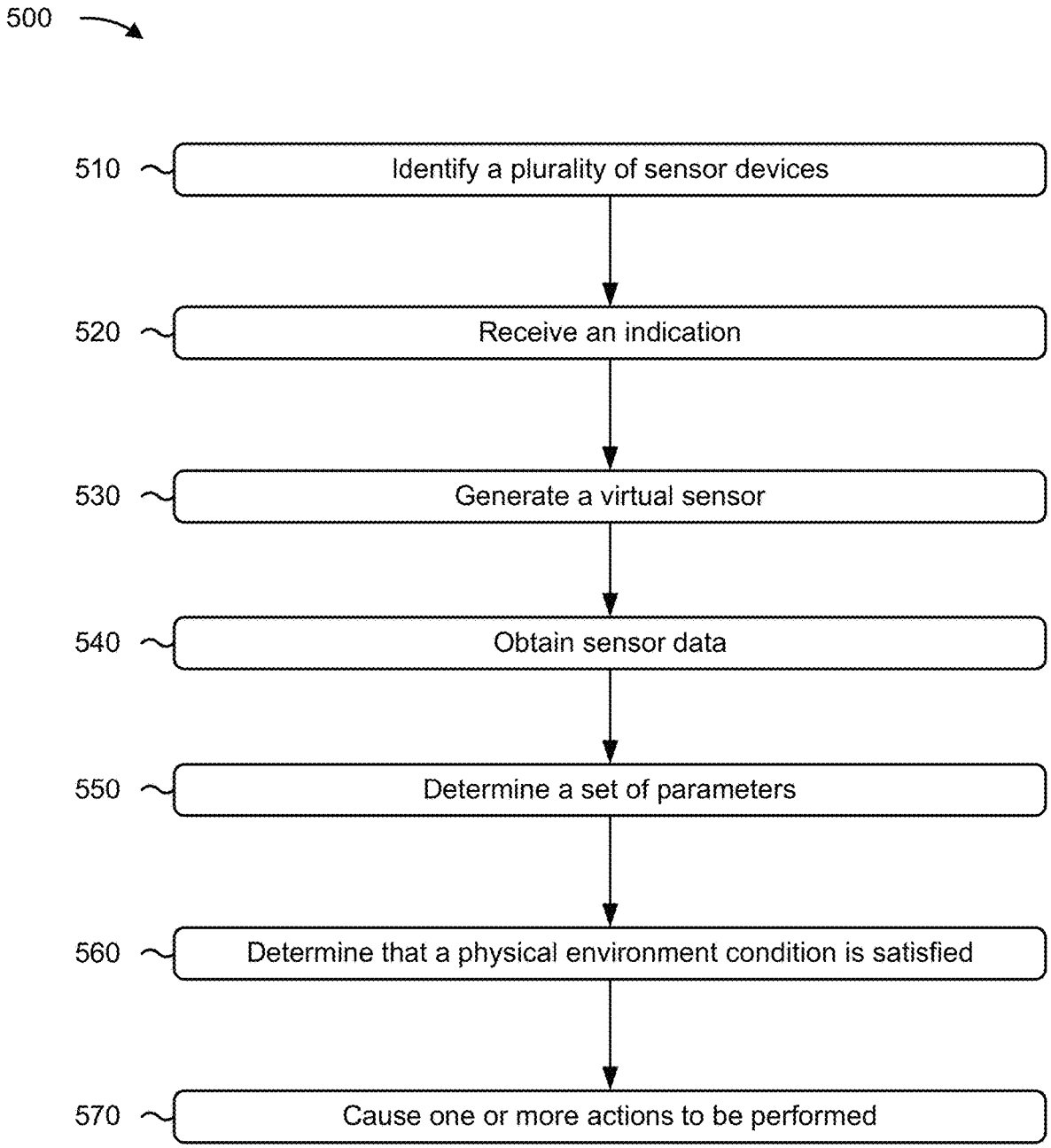
FIGS. 5-6 are flowcharts of example processes relating to monitoring a physical environment using virtual sensors.

FIG. 5 is a flowchart of an example process 500 associated with monitoring a physical environment using virtual sensors. In some implementations, one or more process blocks of FIG. 5 may be performed by a system (e.g., monitoring system 112). In some implementations, one or more process blocks of FIG. 5 may be performed by another device or a group of devices separate from or including the system, such as a sensor device (e.g., sensor device 102), a data collector device (e.g., data collector device 104), a CPE (e.g., CPE 106), a gateway device (e.g., gateway device 108), a client device (e.g., client device 110), and/or computing hardware (e.g., computing hardware 303). Additionally, or alternatively, one or more process blocks of FIG. 5 may be performed by one or more components of device 400, such as processor 420, memory 430, storage component 440, input component 450, output component 460, and/or communication component 470.

As shown in FIG. 5, process 500 may include identifying a plurality of sensor devices (block 510). For example, the system may identify a plurality of sensor devices that are associated with a physical environment, as described above.

In some implementations, identifying the set plurality of sensor devices includes communicating with a data structure to obtain sensor device information that indicates, for a particular sensor device, of the set plurality of sensor devices, at least one of an identifier associated with the particular sensor device; a vendor associated with the particular sensor device; a type of the particular sensor device; a physical location of the particular sensor device within the physical environment; or a sensor group associated with the particular sensor device.

As further shown in FIG. 5, process 500 may include receiving an indication (block 520). For example, the system may receive an indication that a set of sensor devices, of the plurality of sensor devices, are to be associated with a virtual sensor that is associated with the physical environment, as described above. In some implementations, receiving the indication comprises providing, to a client device, an interactive user interface for display that includes a dashboard and an add sensor functionality, and receiving, based on providing the interactive user interface for display, the indication from the client device. The indication may comprise at least one of information identifying the set of sensor devices, information indicating an identifier of the virtual sensor, information indicating a type of the virtual sensor, information identifying a sensor group associated with the virtual sensor, information indicating a physical location within the physical environment that is associated with the virtual sensor, information identifying one or more attributes of the physical environment that the virtual sensor is to measure, or information indicating how the one or more attributes of the physical environment that the virtual sensor is to measure are related to a set of attributes of the physical environment that the set of sensor devices are configured to measure.

As further shown in FIG. 5, process 500 may include generating a virtual sensor (block 530). For example, the system may generate, based on receiving the indication, a virtual sensor, as described above. In some implementations, generating the virtual sensor comprises identifying a data structure that is configured to store information related to virtual sensors of the physical environment, and causing the data structure to store an entry associated with the virtual sensor, wherein the entry includes at least one of information identifying the set of sensor devices; information indicating an identifier of the virtual sensor; information indicating a type of the virtual sensor; information identifying a sensor group associated with the virtual sensor; information indicating a physical location within the physical environment that is associated with the virtual sensor; information identifying one or more attributes of the physical environment that the virtual sensor is to measure; or information indicating how the one or more attributes of the physical environment that the virtual sensor is to measure are related to a set of attributes of the physical environment that the set of sensor devices are configured to measure.

As further shown in FIG. 5, process 500 may include obtaining sensor data (block 540). For example, the system may obtain sensor data that was captured by the set of sensor devices, as described above. In some implementations, obtaining the sensor data includes sending a request to a gateway device for the sensor data, and receiving, based on sending the request, the sensor data.

As further shown in FIG. 5, process 500 may include determining a set of parameters (block 550). For example, the system may process the sensor data to determine a set of parameters associated with the virtual sensor, as described above. The set of parameters associated with the virtual sensor may indicate a set of measurements associated with one or more attributes of the physical environment. In some implementations, processing the sensor data to determine the set of parameters associated with the virtual sensor comprises identifying a set of sensor data, of the sensor data, that is related to one or more attributes of the physical environment that the virtual sensor is to measure, and processing the set of sensor data to determine the set of parameters associated with the virtual sensor.

As further shown in FIG. 5, process 500 may include determining that a physical environment condition is satisfied (block 560). For example, the system may determine, based on the set of parameters associated with the virtual sensor, that a physical environment condition is satisfied, as described above. In some implementations, determining that the physical environment condition is satisfied comprises processing, using at least one machine learning model and/or at least one graph traversal technique, the set of parameters to determine that the physical environment condition is satisfied. In some implementations, determining that the physical environment condition is satisfied comprises identifying, based on the set of parameters, a measurement associated with an attribute of the physical environment, determining that the measurement satisfies a measurement threshold associated with the attribute of the physical environment, and determining, based on determining that the measurement satisfies the measurement threshold, that the physical environment condition is satisfied.

As further shown in FIG. 5, process 500 may include causing one or more actions to be performed (block 570). For example, the system may cause, based on determining that the physical environment condition is satisfied, one or more actions to be performed, as described above. In some implementations, causing the one or more actions to be performed comprises: generating an alert indicating that the physical environment condition is satisfied, and providing, to a client device, an interactive user interface for display that includes the alert; generating a notification indicating that the physical environment condition is satisfied, and sending, to a client device, a message that includes the notification to cause the client device to display the message; and/or identifying a device associated with the physical environment condition, and automatically causing adjustment of one or more settings of the device.

In some implementations, process 500 may include providing, to a client device, an interactive user interface for display that includes a dashboard that indicates status information related to the virtual sensor and/or an interactive map of the physical environment that indicates at least one of a physical location of at least one sensor device, of the set of sensor devices, within the physical environment, or a physical location within the physical environment that is associated with the virtual sensor.

Although FIG. 5 shows example blocks of process 500, in some implementations, process 500 may include additional blocks, fewer blocks, different blocks, or differently arranged blocks than those depicted in FIG. 5. Additionally, or alternatively, two or more of the blocks of process 500 may be performed in parallel.

Figure 6:
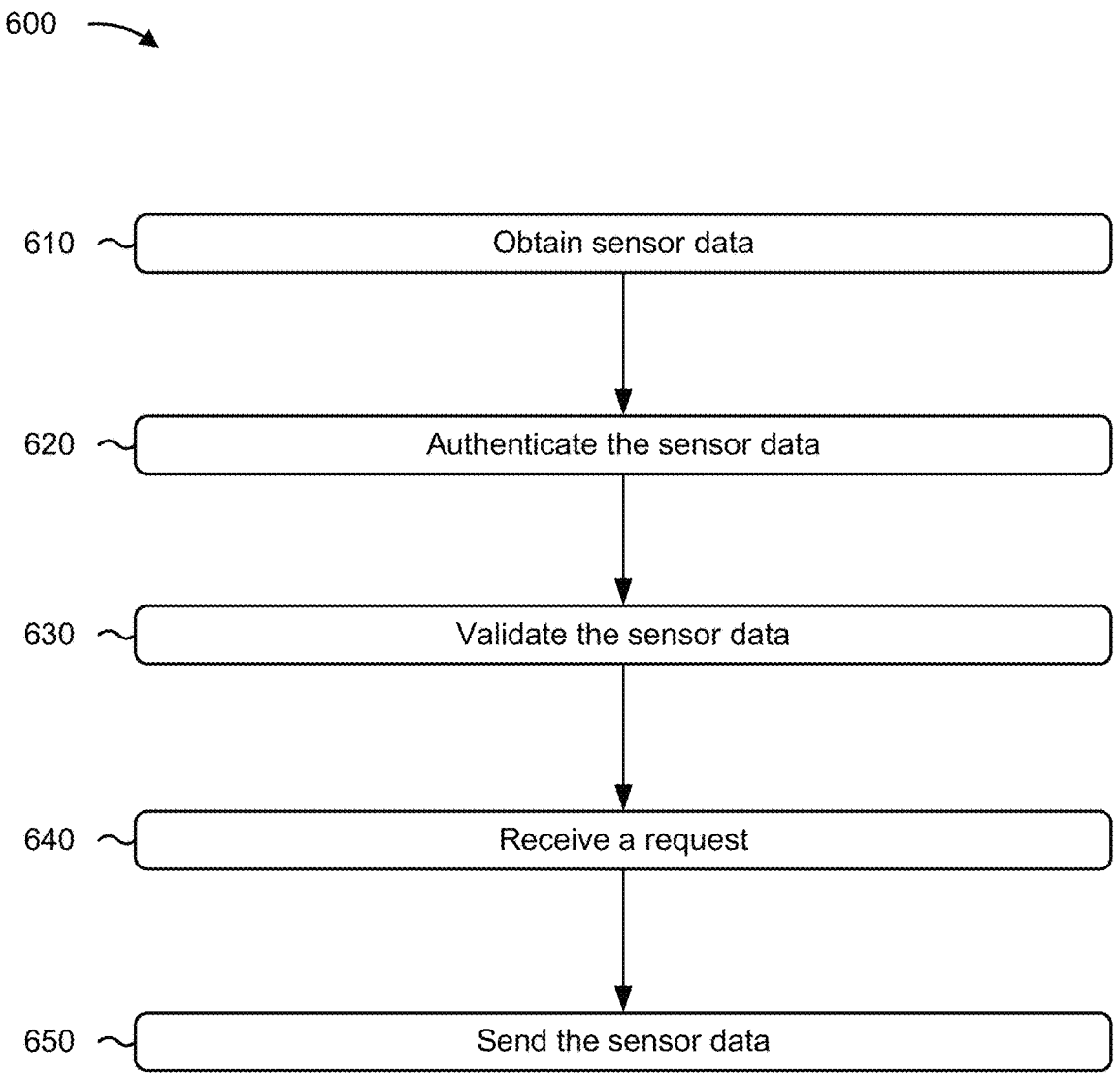

FIG. 6 is a flowchart of an example process 600 associated with monitoring a physical environment using virtual sensors. In some implementations, one or more process blocks of FIG. 6 may be performed by a gateway device (e.g., gateway device 108). In some implementations, one or more process blocks of FIG. 6 may be performed by another device or a group of devices separate from or including the gateway device, such as a sensor device (e.g., sensor device 102), a data collector device (e.g., data collector device 104), a CPE (e.g., CPE 106), a client device (e.g., client device 110), a system (e.g., monitoring system 112), and/or computing hardware (e.g., computing hardware 303). Additionally, or alternatively, one or more process blocks of FIG. 6 may be performed by one or more components of device 400, such as processor 420, memory 430, storage component 440, input component 450, output component 460, and/or communication component 470.

As shown in FIG. 6, process 600 may include obtaining sensor data (block 610). For example, the gateway device may obtain sensor data that was captured by a plurality of sensor devices that are associated with a physical environment, as described above. In some implementations, a set of sensor data included in the sensor data is associated with a set of sensor devices, of the plurality of sensor devices, that are associated with a virtual sensor.

As further shown in FIG. 6, process 600 may include authenticating the sensor data (block 620). For example, the gateway device may authenticate the sensor data, as described above. In some implementations, authenticating the sensor data includes identifying, based on the sensor data, respective network locations of the plurality of sensor devices; determining that the respective network locations of a particular set of sensor devices, of the plurality of sensor devices, are not in a list of network locations; and processing the sensor data to remove a particular set of sensor data from the sensor data that is associated with the particular set of sensor devices.

As further shown in FIG. 6, process 600 may include validating the sensor data (block 630). For example, the gateway device may validate the sensor data, as described above. In some implementations, validating the sensor data includes identifying a particular set of sensor data, of the sensor data, that is associated with a particular sensor device of the plurality of sensor devices, determining that a value associated with the particular set of sensor data is not within an expected value range associated with the particular sensor device, and processing the sensor data to remove the particular set of sensor data from the sensor data.

As further shown in FIG. 6, process 600 may include receiving a request (block 640). For example, the gateway device may receive, after authenticating and validating the sensor data, a request for the sensor data from a system, as described above.

As further shown in FIG. 6, process 600 may include sending the sensor data (block 650). For example, the gateway device may send, based on receiving the request, the sensor data to the system, as described above. In some implementations, sending the sensor data causes the system to determine a set of parameters associated the virtual sensor based on the set of sensor data included in the sensor data.

Although FIG. 6 shows example blocks of process 600, in some implementations, process 600 may include additional blocks, fewer blocks, different blocks, or differently arranged blocks than those depicted in FIG. 6. Additionally, or alternatively, two or more of the blocks of process 600 may be performed in parallel.

As used herein, the term "component" is intended to be broadly construed as hardware, firmware, or a combination of hardware and software. It will be apparent that systems and/or methods described herein may be implemented in different forms of hardware, firmware, and/or a combination of hardware and software. The actual specialized control hardware or software code used to implement these systems and/or methods is not limiting of the implementations. Thus, the operation and behavior of the systems and/or methods are described herein without reference to specific software code—it being understood that software and hardware can be used to implement the systems and/or methods based on the description herein.

As used herein, satisfying a threshold may, depending on the context, refer to a value being greater than the threshold, greater than or equal to the threshold, less than the threshold, less than or equal to the threshold, equal to the threshold, not equal to the threshold, or the like.

To the extent the aforementioned implementations collect, store, or employ personal information of individuals, it should be understood that such information shall be used in accordance with all applicable laws concerning protection of personal information. Additionally, the collection, storage, and use of such information can be subject to consent of the individual to such activity, for example, through well known "opt-in" or "opt-out" processes as can be appropriate for the situation and type of information. Storage and use of personal information can be in an appropriately secure manner reflective of the type of information, for example, through various encryption and anonymization techniques for particularly sensitive information.

Even though particular combinations of features are recited in the claims and/or disclosed in the specification, these combinations are not intended to limit the disclosure of various implementations. In fact, many of these features may be combined in ways not specifically recited in the claims and/or disclosed in the specification. Although each dependent claim listed below may directly depend on only one claim, the disclosure of various implementations includes each dependent claim in combination with every other claim in the claim set. As used herein, a phrase referring to "at least one of" a list of items refers to any combination of those items, including single members. As an example, "at least one of: a, b, or c" is intended to cover a, b, c, a-b, a-c, b-c, and a-b-c, as well as any combination with multiple of the same item.

No element, act, or instruction used herein should be construed as critical or essential unless explicitly described as such. Also, as used herein, the articles "a" and "an" are intended to include one or more items, and may be used interchangeably with "one or more." Further, as used herein, the article "the" is intended to include one or more items referenced in connection with the article "the" and may be used interchangeably with "the one or more." Furthermore, as used herein, the term "set" is intended to include one or more items (e.g., related items, unrelated items, or a combination of related and unrelated items), and may be used interchangeably with "one or more." Where only one item is intended, the phrase "only one" or similar language is used. Also, as used herein, the terms "has," "have," "having," or the like are intended to be open-ended terms. Further, the phrase "based on" is intended to mean "based, at least in part, on" unless explicitly stated otherwise. Also, as used herein, the term "or" is intended to be inclusive when used in a series and may be used interchangeably with "and/or," unless explicitly stated otherwise (e.g., if used in combination with "either" or "only one of").

In the preceding specification, various example embodiments have been described with reference to the accompanying drawings. It will, however, be evident that various modifications and changes may be made thereto, and additional embodiments may be implemented, without departing from the broader scope of the invention as set forth in the claims that follow. The specification and drawings are accordingly to be regarded in an illustrative rather than restrictive sense.

What is claimed is:

1. A method, comprising:

identifying a plurality of sensor devices that are associated with a physical environment;

receiving an indication that a set of sensor devices, of the plurality of sensor devices, are to be associated with a virtual sensor that is associated with the physical environment;

generating, based on receiving the indication, the virtual sensor;

obtaining sensor data that was captured by the set of sensor devices;

processing the sensor data to measure at least one of a heat index or an occupancy status of the physical environment;

determining based on the at least one of the heat index or the occupancy status of the physical environment, that a physical environment condition is satisfied; and causing, based on determining that the physical environment condition is satisfied, one or more actions to be performed.

2. The method of claim 1, wherein identifying the plurality of sensor devices comprises:

communicating with a data structure to obtain sensor device information that indicates, for a particular sensor device, of the plurality of sensor devices, at least one of:

an identifier associated with the particular sensor device;

a vendor associated with the particular sensor device;

a type of the particular sensor device;

a physical location of the particular sensor device within the physical environment; or a sensor group associated with the particular sensor device.

3. The method of claim 1, wherein obtaining the sensor data comprises:

receiving the sensor data from a gateway device.

4. The method of claim 1, wherein the indication comprises at least one of:

information identifying the set of sensor devices;

information indicating an identifier of the virtual sensor;

information indicating a type of the virtual sensor;

information identifying a sensor group associated with the virtual sensor;

information indicating a physical location within the physical environment that is associated with the virtual sensor;

information identifying the at least one of the heat index or the occupancy status of the physical environment; or information indicating how the at least one of the heat index or the occupancy status of the physical environment is related to a set of attributes of the physical environment that the set of sensor devices are configured to measure.

5. The method of claim 1, wherein generating the virtual sensor comprises:

identifying a data structure that is configured to store information related to virtual sensors of the physical environment; and causing the data structure to store an entry associated with the virtual sensor, wherein the entry includes at least one of:

information identifying the set of sensor devices;

information indicating an identifier of the virtual sensor;

information indicating a type of the virtual sensor;

information identifying a sensor group associated with the virtual sensor;

information indicating a physical location within the building physical environment that is associated with the virtual sensor;

information identifying the at least one of the heat index or the occupancy status of the physical environment; or information indicating how the at least one of the heat index or the occupancy status of the physical environment is related to a set of attributes of the physical environment that the set of sensor devices are configured to measure.

6. The method of claim 1, wherein processing the sensor data to measure the at least one of the heat index or the occupancy status of the physical environment comprises:

identifying a set of sensor data, of the sensor data, that is related to the at least one of the heat index or the occupancy status of the physical environment; and processing the set of sensor data to measure the at least one of the heat index or the occupancy status of the physical environment.

7. The method of claim 1, wherein determining that the physical environment condition is satisfied comprises:

processing, using at least one machine learning model, a measurement associated with the at least one of the heat index or the occupancy status of the physical environment to determine that the physical environment condition is satisfied.

8. The method of claim 1, wherein determining that the physical environment condition is satisfied comprises:

identifying a measurement associated with the at least one of the heat index or the occupancy status of the physical environment;

determining that the measurement satisfies a measurement threshold associated with the at least one of the heat index or the occupancy status of the physical environment; and determining, based on determining that the measurement satisfies the measurement threshold, that the physical environment condition is satisfied.

9. The method of claim 1, further comprising:

providing, to a client device, an interactive map of the physical environment that indicates at least one of:

a physical location of at least one sensor device, of the set of sensor devices, within the physical environment; or a physical location within the physical environment that is associated with the virtual sensor.

10. The method of claim 1, wherein causing the one or more actions to be performed comprises:

generating an alert indicating that the physical environment condition is satisfied; and providing, to a client device, an interactive user interface for display that includes the alert.

11. A non-transitory computer-readable medium storing a set of instructions, the set of instructions comprising:

one or more instructions that, when executed by one or more processors, cause the one or more processors to:

obtain sensor data that was captured by a set of sensor devices that are associated with a physical environment, wherein the set of sensor devices are associated with a virtual sensor that is associated with the physical environment;

process the sensor data to measure at least one of a heat index or an occupancy status of the physical environment;

determine, based on the at least one of the heat index or the occupancy status of the physical environment, that a physical environment condition is satisfied; and cause, based on determining that the physical environment condition is satisfied, one or more actions to be performed.

12. The non-transitory computer-readable medium of claim 11, wherein the one or more instructions, that cause the one or more processors to obtain the sensor data, cause the one or more processors to:

send a request to a gateway device for the sensor data; and receive, based on sending the request, the sensor data.

13. The non-transitory computer-readable medium of claim 11, wherein the one or more instructions, that cause the one or more processors to determine that the physical environment condition is satisfied, cause the one or more processors to:

process, using at least one graph traversal technique, a measurement associated with the at least one of the heat index or the occupancy status of the physical environment to determine that the physical environment condition is satisfied.

14. The non-transitory computer-readable medium of claim 11, wherein the one or more instructions, that cause the one or more processors to cause the one or more actions to be performed, cause the one or more processors to at least one of:

dispatch a service operator to service a device associated with the physical environment condition; or generate a work order to have the device serviced.

15. The non-transitory computer-readable medium of claim 11, wherein the one or more instructions, that cause the one or more processors to cause the one or more actions to be performed, cause the one or more processors to:

generate a notification indicating that the physical environment condition is satisfied; and send, to a client device, a message that includes the notification to cause the client device to display the message.

16. The non-transitory computer-readable medium of claim 11, wherein the one or more instructions, that cause the one or more processors to cause the one or more actions to be performed, cause the one or more processors to:

identify a device associated with the physical environment condition; and automatically cause adjustment of one or more settings of the device.

17. The non-transitory computer-readable medium of claim 11, wherein the physical environment is a building.

18. A device, comprising:

one or more processors configured to:

obtain sensor data that was captured by a plurality of sensor devices that are associated with a physical environment, wherein a set of sensor data included in the sensor data is associated with a set of sensor devices, of the plurality of sensor devices, that are associated with a virtual sensor;

authenticate the sensor data;

validate the sensor data;

receive, after authenticating and validating the sensor data, a request for the sensor data from a system; and send, based on receiving the request, the sensor data to the system, wherein sending the sensor data causes the system to determine a set of parameters associated the virtual sensor based on the set of sensor data included in the sensor data.

19. The device of claim 18, wherein the one or more processors, when authenticating the sensor data, are configured to:

identify, based on the sensor data, respective network locations of the plurality of sensor devices;

determine that the respective network locations of a particular set of sensor devices, of the plurality of sensor devices, are not in a list of network locations; and process the sensor data to remove a particular set of sensor data from the sensor data that is associated with the particular set of sensor devices.

20. The device of claim 18, wherein the one or more processors, when validating the sensor data, are configured to:

identify a particular set of sensor data, of the sensor data, that is associated with a particular sensor device of the plurality of sensor devices;

determine that a value associated with the particular set of sensor data is not within an expected value range associated with the particular sensor device; and process the sensor data to remove the particular set of sensor data from the sensor data.

* * * * *